US006629838B1

(12) United States Patent
Van Vuuren et al.

(10) Patent No.: US 6,629,838 B1
(45) Date of Patent: Oct. 7, 2003

(54) ENDOTHERMIC HEAT TREATMENT OF SOLIDS LOADED ON TROLLEYS MOVING IN A KILN

(76) Inventors: David Steyn Van Vuuren, 274 Albert Street, Waterkloof 0181, Pretoria (ZA); Alexander McClaren Morrison, 285 Charles Barry Avenue, Bronberrik 0157, Centurion (ZA); Andrew Kenneth Stone, 3 Thatch Place, 846 Petrick Street, Faerio Glen 0043, Pretoria (ZA)

( * ) Notice: Subject to any disclaimer, the term of this patent is extended or adjusted under 35 U.S.C. 154(b) by 0 days.

(21) Appl. No.: 09/914,522

(22) PCT Filed: Feb. 23, 2000

(86) PCT No.: PCT/IB00/00195

§ 371 (c)(1),
(2), (4) Date: Dec. 20, 2001

(87) PCT Pub. No.: WO00/52215

PCT Pub. Date: Sep. 8, 2000

(30) Foreign Application Priority Data

Mar. 2, 1999 (ZA) ..... 99/1674
Nov. 25, 1999 (ZA) ..... 99/7322

(51) Int. Cl.[7] ..... F27B 9/00

(52) U.S. Cl. ..... 432/148; 432/128; 432/133; 432/143; 432/147; 432/149

(58) Field of Search ..... 432/128, 133, 432/136, 143, 147, 148, 149

(56) References Cited

U.S. PATENT DOCUMENTS 1,054,873 A 3/1913 Sieurin
1,065,890 A 6/1913 Sieurin
4,005,981 A * 2/1977 Turnbull ..... 432/128
4,397,451 A * 8/1983 Kinoshita et al. ..... 219/388
4,627,814 A * 12/1986 Hattori et al. ..... 432/128
4,773,851 A 9/1988 Mueller
4,932,864 A * 6/1990 Miyabe ..... 432/128
4,978,294 A 12/1990 Uemura et al.

FOREIGN PATENT DOCUMENTS

| | | | |
|---|---|---|---|
| DE | 3437970 A1 | | 8/1985 |
| DE | 3722709 | * | 6/1988 |
| JP | 58067813 | * | 4/1983 |
| JP | 62-256938 | | 11/1987 |
| JP | 62-297406 A | | 12/1987 |
| JP | 06322424 | * | 11/1994 |
| JP | 7-126724 | | 5/1995 |
| SU | 1451107 A1 | | 1/1989 |
| WO | WO 93/16342 A1 | | 8/1993 |

OTHER PUBLICATIONS

The Making, Shaping and Treating of Steel, Ninth Edition, United States Steel, Edited by Harold E. McGannon, p. 407.
Database WPI, Abstract of SU 1451107A.

* cited by examiner

*Primary Examiner*—Jiping Lu
(74) *Attorney, Agent, or Firm*—Rothwell, Figg, Ernst & Manbeck

(57) ABSTRACT

The invention provides a process and installation for the treatment of a solid. The process includes passing the solid along a kiln having a hollow interior, while supporting the solid on supports moved successively along the kiln and heating the solid, by radiant heat, to a temperature at which it undergoes an endothermic chemical reaction. The installation includes a kiln having a hollow interior with an inlet end and an outlet end, a roof, a floor and a pair of opposed side walls, and a path for supports loaded with the solid to pass successively along in the interior, from the inlet end to the outlet end, the path extending along the floor. The installation includes heating surfaces for radiating heat towards the solid on supports passing along the path, and a plurality of supports, movable in succession along the path.

23 Claims, 12 Drawing Sheets

ENDOTHERMIC HEAT TREATMENT OF SOLIDS LOADED ON TROLLEYS MOVING IN A KILN

THIS INVENTION relates to a process and installation for the treatment of solid material by means of an endothermic chemical reaction. More particularly, the invention relates to a process for the treatment of a solid material such as a mineral to cause it to undergo an endothermic chemical reaction, and to an installation for the treatment of such solid material undergoing said endothermic reaction, the process and installation being suitable for, but not limited to, the treatment of a mineral at elevated temperatures at which the mineral being treated become sticky and/or soft. The invention also relates to a kiln forming part of the installation.

The Applicant is aware of the abstract of Japanese Published Patent Application 56166155, published under publication number JP-A-58067813, which abstract has been published in Patent Abstracts of Japan, Volume 7, No. 155 (C-175), Jul. 7, 1983. This abstract discloses a process for the treatment by reduction and sintering of a solid material by passing the solid material along the inside of a tunnel kiln comprising a horizontally extending tunnel having a hollow interior. The solid material is supported on a series of supports as it passes along the kiln, the supports being moved successively along the interior of the kiln. The solid material is heated, by means of radiant heat radiated on the solid material, as it passes along the kiln, to a temperature at which it undergoes an endothermic reaction. A fuel such as coke oven gas is supplied to a burner in the roof of the kiln, so that heat is produced by combustion in a combustion zone in the upper part of the kiln, separate from a reaction zone where reduction and sintering of the solid material is carried out, in the lower part of the kiln. The Applicant is also aware of U.S. Pat. No. 4,978,294 which discloses a process whereby, in a rotary furnace, partitions are used to keep combustion gases separate from minerals being reduced, so that re-oxidation of the minerals is resisted. The Applicant is further aware of published International Patent Application WO-A-93/16342 which discloses shapes in the form of extruded pipes consolidated from particles of solid material, which are stacked on supports during heating thereof.

According to one aspect of the invention there is provided a process for the treatment of a solid material, the process including the process steps of:

passing the solid material along the inside of a kiln comprising a horizontally extending tunnel having a hollow interior;

supporting the solid material on a succession of supports as it passes along the kiln, the supports being moved successively along the interior of the kiln; and heating the solid material, by means of radiant heat radiated on to the solid material, as it passes along the kiln, to a temperature at which the solid material undergoes an endothermic chemical reaction, the heat which is radiated on to the solid material being produced by combustion in a combustion zone separated by at least one member of the group consisting of partitions, panels and baffles from a reaction zone through which the solid material supported on the supports passes during the heating.

According to another aspect of the invention there is provided a process for the treatment of solid material, the process including the steps of:

passing the solid material along the inside of a kiln comprising a horizontally extending tunnel having a hollow interior;

supporting the solid material on a succession of supports as it passes along the kiln, the supports being moved successively along the interior of the kiln; and heating the solid material, by means of radiant heat radiated on to the solid material, as it passes along the kiln, to a temperature at which the solid material undergoes an endothermic chemical reaction, the process including the step of consolidating particles of the solid material into shapes which are arranged in stacks on the supports.

Each support may be in the form of a wheeled trolley, the process including loading a succession of the trolleys with the solid material to be treated, each trolley being loaded on an upwardly facing support surface of a load bed of the trolley, the moving of the supports along the interior of the kiln being by rolling the loaded trolleys in succession along a path extending, below the interior of the kiln, along the length of the kiln, The kiln may have an inlet end and an outlet end, each of which ends is provided with an airlock, the process including the steps of inserting the loaded trolleys in succession into the inlet end of the kiln, and withdrawing the loaded trolleys in succession from the outlet end of the kiln, the airlocks acting to promote the maintenance of an atmosphere inside the kiln which is different from the ambient atmosphere outside the kiln, which atmosphere inside the kiln promotes the endothermic reaction.

Heating the mineral may be by radiant heat provided in a reaction zone in the tunnel by heating surfaces of electric heating elements in the tunnel. However, heating the mineral is preferably by radiant heat emitted by one or more heating surfaces facing towards the mineral on the trolleys in said reaction zone in the interior of the tunnel, the heating surfaces being heated by a combustion gas and being provided by one or more partitions in the interior of the tunnel and the combustion taking place on the side of each partition remote from the mineral on the trolleys. In other words, the heating of the solid material may be by radiant heat emitted by one or more heating surfaces in the interior of the kiln and facing towards the solid material passing along the kiln, each heating surface being provided by a partition in the interior of the kiln and each partition having opposite sides facing respectively towards and away from the solid material, each partition being heated by a combustion gas located on the side of the partition facing away from the solid material. Instead, heating may be by radiation from a flame created by combustion of a gas.

The process may include the step of consolidating particles of the solid material into shapes to promote heating thereof in the kiln, eg by both convective and radiant heating, the shapes being stacked on the supports and the process including the step of removing from the vicinity of the shapes any gaseous products formed by the heating of the shapes, eg formed by the endothermic reaction and which can inhibit continuance of such reaction. The process may, accordingly, include the step of stacking consolidated shapes on the trolleys. Instead or in addition, the solid material or mineral to be heated may be loaded on trays, the trays in turn being loaded in spaced positions on the trolleys, each trolley carrying a plurality of trays. When consolidated shapes are employed, they may be in the form of extrusions or compacted mouldings, the solid material being milled prior to its being extruded or moulded and optionally being mixed with one or more constituents selected from reagents such as reductants which participate in the endothermic reaction, selected from catalysts or fluxes which can enhance the endothermic reaction, and selected from binders for facilitating the consolidation.

The solid material may, in the interior of the tunnel and prior to the radiant heating thereof to cause the endothermic reaction, be subjected to pre-heating. The pre-heating may be by radiant heating, eg similar to the heating in the reaction zone, or preferably by convective heating, for example by forced convection achieved by circulating a hot gas transversely through the interior of the tunnel and over the solid material on the trolleys. The hot gas may be heated by a heat exchanger, or it may be a hot combustion gas. In the interior of the tunnel and after the endothermic reaction, the reaction product formed by the endothermic reaction may be cooled by conveying the reaction product along a cooling zone in the interior of the tunnel, prior to withdrawal of the trolleys from the tunnel. In the case of reducing reactions, gas produced as a by-product of an endothermic reducing reaction may be withdrawn from the vicinity of the solid material or of its reaction product, and may be burnt to form the combustion gas which heats the panels of the reaction zone.

In particular, the mineral to be heated may comprise particles consolidated into chevron shapes made up of two flat slabs intersecting at a corner, being stackable on the edges of the slabs in stable fashion on a flat load bed of a trolley, with the shapes arranged in a spaced roughly nesting arrangement which permits radiant heating of the slab faces from above and gas flow over the slab faces from either side of the trolley to the other. Instead, the shapes may be in the form of hollow cubes or blocks having openings into hollow interiors via at least three faces thereof, to permit, when they are stacked on trolleys, radiation to enter their interiors from above, while permitting gas to pass through their interiors from either side of the trolley to the other. The nature of the shapes and the thickness of the material thereof may be chosen to promote one or more of good heat transfer to the shapes, good diffusion of reactive gases into the shapes, good strength of the shapes and good dimensional stability of the shapes.

A further feature of the process of the invention is the possibility of producing a reduced product of a shape and/or size which can be employed in a subsequent processing step without the necessity of any size reduction thereof such as milling thereof. Thus, shapes of small size and/or low wall thickness may be used, capable of being fed directly to a subsequent smelting step, without size reduction. In such cases, when the next step to which the mineral will be subjected may be smelting, the process contemplates transferring the consolidated shapes, after the endothermic reaction, in a hot state, without cooling, to the smelting step or the like step.

When the endothermic reaction is a reduction of the solid material or mineral, a solid or liquid reductant, which may be carbonaceous, may be mixed with the mineral to be reduced, or a gaseous reductant, which may be hydrogen or may be carbon-containing, may form part of the gas passed over the mineral on the trolleys. Thus, a solid reductant, such as coal or char, or a liquid reductant such as tar, may be included as constituent of consolidated shapes stacked on the trolleys; or a liquid such as fuel oil may be mixed with the mineral held in trays stacked on the trolleys. When the reductant is part of the gas circulated over the mineral, it may be hydrogen or a hydrocarbon gas such as methane, or it may be carbon monoxide, or the like.

In particular, when the endothermic reaction is a reduction, the process may include the step of admixing the particles of solid material, before consolidation thereof, with a carbon-containing reductant, the consolidation being into shapes of a size such that the process produces a product in the form of shapes of reduced solid material which can subsequently be smelted without any size reduction prior to the smelting thereof. As indicated above, the process may include the step, prior to the radiant heating thereof to cause the endothermic reaction, of pre-heating the solid material, and includes, after said radiant heating, the step of cooling the solid material.

In a particular embodiment, hot gas from the reaction zone may be used for the pre-heating. This gas may initially be too hot for circulation by fans, being eg at 1600° C. or more, whereas fans are preferably operated at below eg 900° C. In this case the hot gas may be diluted with air to lower its temperature before it passes over the fan or fans. If this dilution oxidizes carbon monoxide fully to carbon dioxide in the hot gas by reaction of oxygen in the air with carbon monoxide in the hot gas, the carbon dioxide produced may react unacceptably or undesirably with any carbonaceous reductant in the consolidated mineral, rendering the hot gas unsuitable for passing over the mineral. Similarly, if sufficient excess air is added to lower the hot gas temperature for there to be oxygen present in the cooled diluted gas, it can react undesirably with said carbonaceous reductant. In such cases the gas from the reaction zone may be used, via a heat exchanger, to heat a reducing gas with suitable reducing properties, which reducing gas is circulated over the mineral by one or more fans. Instead, baffles in the tunnel on opposite sides of the trolley track may be used to direct hot gas from the reaction zone in zig-zag fashion across mineral on a train of trolleys on the track, in an upstream direction relative to trolley movement away from the reaction zone, gas flow being caused by an extraction fan for withdrawing gas from the tunnel, and the gas being cooled by heat exchange with the mineral on the trolleys moving countercurrently to the gas, the mineral being heated by the gas.

When combustible volatiles are formed from carbonaceous reductants during the pre-heating step, it may be preferred to withdraw gases from the pre-heating step into the reaction zone for combustion thereof there to form combustion gases for heating the reaction zone. Instead, such volatiles may be removed from exhaust gases from the preheating at a position where they are sufficiently hot for addition of air thereto to cause complete combustion of the volatiles.

When, as indicated above, radiation from one or more heating surfaces heated by combustion gases is used to heat the mineral, the heating surfaces may be located alongside the track, eg on opposite sides of a train of trolleys on the track, and/or a heating surface may be located above the trolleys. This acts to separate the reaction zone from the combustion zone in which the combustion gases are produced. If a said heating surface is provided by a panel or wall made of a refractory membrane such as a silicon carbide membrane, cracking or breaking of the membrane can lead to undesirable downtime. A possibility contemplated by the present invention is thus to provide each trolley with its own heating surface or surfaces. Thus, each trolley may be provided with a roof and/or walls, eg as a box of refractory membrane, more or less enclosing the mineral on the trolley and separating it from combustion gases. In particular, a panel of such membrane may be loosely and removably placed on top of the mineral stacked on the trolley. Such panels can be kept from sticking to the mineral by means of carbon layers, provided eg by layers of coal or sawdust, spread on the mineral below the panels. The panels can be removed from trolleys which have left the tunnel and recycled to the tunnel entrance for re-use.

In other words, the process may include the step of heating the solid material on the supports by means of a plurality of heating membranes, one for each support, each heating membrane being supported on one of the supports and passing along the inside of the kiln on said support, the heating membranes radiating the radiant heat on to the solid material on said support and the process including using each membrane to heat solid material in turn on each of a plurality of the supports passing along the kiln.

Instead of using a panel or membrane to keep carbon dioxide or oxygen away from the mineral, a sufficient rate of carbon monoxide evolution in the mineral in the reaction zone may prevent or acceptably reduce carbon dioxide flow or diffusion towards and/or into the mineral Using excess reductant in the mineral can assist this and can confine any reoxidation of reduced mineral by carbon dioxide to the surface regions of consolidated mineral shapes. The geometry of the consolidated shapes, and their arrangement and spacing on the trolleys, may also be selected to resist flow or diffusion of carbon dioxide towards the surfaces of the shapes. Lowering gas velocities of the combustion gases above the trolleys, and the provision of suitable baffles, can also be employed to resist such reoxidation of reduced mineral by carbon dioxide from the combustion gases. These baffles can be part of the tunnel or can be mounted on the trolleys above the material.

The process of the invention may further involve the pre-heating of any air or oxygen used to form combustion gases for heating the reaction zone. This pre-heating can be by means of a heat exchanger heated by combustion gases which have been used to heat the reaction zone.

According to another aspect of the invention there is provided an installation for the treatment of solid material undergoing an endothermic chemical reaction, the installation including:

- a kiln in the form of a horizontally extending tunnel having a hollow interior with an inlet end and an outlet end, the tunnel having a roof, a floor and a pair of opposed side walls;
- a path for supports loaded with the solid material to pass along in the interior of the tunnel in succession, from the inlet end of the kiln to the outlet end thereof, the path extending along the floor at the bottom of the interior of the tunnel from the inlet end of the kiln to the outlet end thereof;
- one or more heating surfaces for radiating radiant heat towards solid material loaded on supports passing along the path from said inlet end to said outlet end; and
- a plurality of supports, movable in succession along the path from the inlet end of the kiln to the outlet end thereof, the kiln having a reaction chamber in the interior of the tunnel which is separated from a combustion chamber in the interior of the tunnel by at least one member of the group consisting of partitions, panels and baffles, the floor of the tunnel providing a floor for the reaction chamber along which reaction chamber floor the path for the supports extends.

The supports may be in the form of wheeled trolleys, the path being in the form of a track comprising a pair of spaced rails for supporting the wheels of the trolleys.

The inlet end and the outlet end of the tunnel may each be provided with an airlock, for example a double-door chamber capable of receiving a support, the chamber having an inner door leading into the interior of the tunnel, and an outer door leading to the exterior of the kiln, the doors of each airlock being arranged so that, when the inner door is open, the associated outer door is closed, and so that, when the outer door is open, the associated inner door is closed. In other words, the installation may include an inlet airlock into the kiln at the inlet end of the kiln, and an outlet airlock out of the kiln at the outlet end of the kiln, for promoting isolation of an atmosphere in the interior of the kiln from the ambient atmosphere outside the kiln.

The tunnel may have its roof, side walls and floor made of a refractory material which preferably has heat-insulating properties to resist heat loss from the interior of the kiln. In a particular construction the track or path may be in the form of a channel extending along the length of the floor of the tunnel, midway between the side walls, for receiving the supports such as trolleys, the channel optionally having a pair of spaced rails extending along its length for supporting the wheels of the trolleys, each support having an upwardly facing load bed at the same height as the floor of the tunnel. Each trolley may thus have a load bed, conveniently flat, horizontal and upwardly facing, of a refractory material which preferably has heat-insulating properties, its load bed registering with the floor of the tunnel and preferably fitting with a close operating clearance between opposed parts of the floor on opposite sides of the channel.

The tunnel may have a reaction zone in which the heating surface or surfaces are provided. While these heating surfaces may be provided by electric heating elements, in a particular construction of the kiln the reaction zone is provided by part of the interior of the tunnel, which is divided by a pair of longitudinally extending panels or partitions into three longitudinally extending chambers, the partitions reaching upwardly from the floor of the tunnel, on opposite sides of the channel, to the roof of the tunnel, and dividing the interior of the tunnel into a central longitudinally extending reaction chamber along the floor of which the channel extends, and, on opposite sides of the reaction chamber, a pair of longitudinally extending combustion chambers defining combustion zones. In a development of this feature, a combustion zone in a combustion chamber may be provided in similar fashion above the reaction chamber and extending along the length of the reaction chamber, a panel or partition above the reaction chamber separating it from this combustion chamber and radiating heat downwardly into and on to the shapes or particulate reaction mixture. Any shapes and stacking arrangement used may thus be selected to facilitate radiant heating of the mineral from above. In general, thus, each heating surface may be provided by a longitudinal partition extending longitudinally along the interior of the tunnel and separating a reaction chamber in the interior of the tunnel from a combustion chamber in the interior of the tunnel, the floor of the tunnel providing a floor for the reaction chamber along which reaction chamber floor the path for the supports extends.

Instead, the heating surface may be provided by the interior surface of the roof of the tunnel, the tunnel being provided, in the reaction zone, with a plurality of longitudinally spaced baffles in the form of transverse partitions extending between the side walls, the baffles being spaced below the roof of the tunnel and spaced above the floor of the tunnel.

The tunnel may have a heating zone, upstream of the reaction zone and between the reaction zone and the air lock at the inlet end of the kiln; and the kiln may have a cooling zone, downstream of the reaction zone and between the reaction zone and the airlock at the outlet end of the kiln, the heating zone and cooling zone respectively being in communication with the reaction chamber of the reaction zone. In other words, the kiln may have a heating zone between the reaction zone and the inlet end of the kiln and a cooling zone between the reaction zone and the outlet end of the kiln, the heating zone and the cooling zone respectively being in communication with opposite ends of the reaction zone, and the path extending along the floor of the tunnel in the heating zone and in the cooling zone. The cooling zone may have one or more gas outlets feeding into the combustion chambers of the reaction zone; and the heating zone may be provided with a heating circuit, the heating circuit comprising hot gas circulation means such as a blower or, preferably, a fan, and/or with a gas heater such as a burner or heat exchanger, the circuit being arranged to convey hot gas from the heater to the heating zone of the kiln and to circulate it transversely through the heating zone, from one side of the heating zone to the other, and over mineral on the trolleys passing along the heating zone, to pre-heat the mineral before it enters the reaction chamber. There may be a plurality of such heating circuits, spaced in series along the length of the heating zone.

In a particular construction of the kiln, the cooling zone may have a pair of gas outlets feeding respectively into the downstream ends of the combustion chambers of the reaction zone, the combustion chambers each having a plurality of air inlets spaced in series along the length of the combustion chambers; and each combustion chamber may have a combustion gas outlet at its upstream end. Each of the heating zone and the cooling zone may be provided with one or more baffles or partitions reaching upwardly from the floor to the roof of the tunnel, and extending from the side walls of the tunnel, and across the floor of the tunnel, up to the edges of the channel in the floor of the tunnel, to resist gas flow longitudinally along the tunnel, on opposite sides of the trolleys in the heating zone and cooling zone; and similar partitions or baffles may be provided at opposite ends of the reaction chamber, to resist gas flow longitudinally into or out of the reaction chamber. Generally, thus, the tunnel may have, in its interior, a plurality of transverse partitions on each side of the path, the partitions resisting gas flow along the tunnel on opposite sides of the path in the heating zone and in the cooling zone, and the partitions resisting gas flow along the kiln on opposite sides of the path, into and out of the reaction zone.

In a further particular construction of the kiln, it may be provided with partitions or baffles on opposite sides of the track in the heating zone, and an extraction fan at the trolley inlet end of the heating zone, remote from the reaction zone, the baffles being arranged to cause gas withdrawn by the fan from the reaction zone-through and along the heating zone and expelled from the heating zone, to follow a zig-zag path along the heating zone, from side-to-side across the track and across any train of trolleys on the track. This fan may have a cooling air feed to its inlet for cooling the hot gases passing through it. In other words, there may be a plurality of the transverse partitions in the heating zone on opposite sides of the path, the partitions in the heating zone on each side of the path being staggered with regard to the partitions in the heating zone on the opposite side of the path, thereby being arranged to encourage gas flowing along the length of the tunnel in the heating zone to follow a zig-zag path along the heating zone, from side to side across the path and across any solid material on supports on the path.

As indicated above, a particular feature of the kiln of the present invention the provision, in what can be regarded as the freeboard of the tunnel, above any train of trolleys in the tunnel, a plurality of baffles extending across the width of the tunnel between its side walls, and below its roof, a combustion chamber being defined below the roof and above these baffles, and these baffles acting to reduce gas flow rates and turbulence above the train, thereby to resist passage or diffusion of carbon dioxide downwardly from the combustion chamber to material on the trolleys, and to promote non-turbulent flow of gases produced in the reaction zone in a direction upwardly from the trolleys and into the combustion zone in the combustion chamber.

The invention extends also to a kiln for the treatment of solid material undergoing an endothermic chemical reaction, the kiln including:

a horizontally extending tunnel having a hollow interior with an inlet end and an outlet end, the tunnel having a roof, a floor and a pair of opposed side walls;

a path for supports loaded with solid material to pass along in the interior of the tunnel in succession, from the inlet end of the kiln to the outlet end thereof, the path extending along the floor at the bottom of the interior of the tunnel from the inlet end of the kiln to the outlet end thereof; and one or more heating surfaces for radiating radiant heat towards solid material loaded on supports passing along the path from said inlet end to said outlet end, the kiln having a reaction chamber in the interior of the tunnel which is separated from the combustion chamber in the interior of the tunnel by at least one member of the group consisting of partitions, panels and baffles, the floor of the tunnel providing a floor for the reaction chamber along which reaction chamber floor the path for the supports extends.

The invention will now be described by way of example, with reference to the accompanying diagrammatic drawings, in which.

Figure 1:
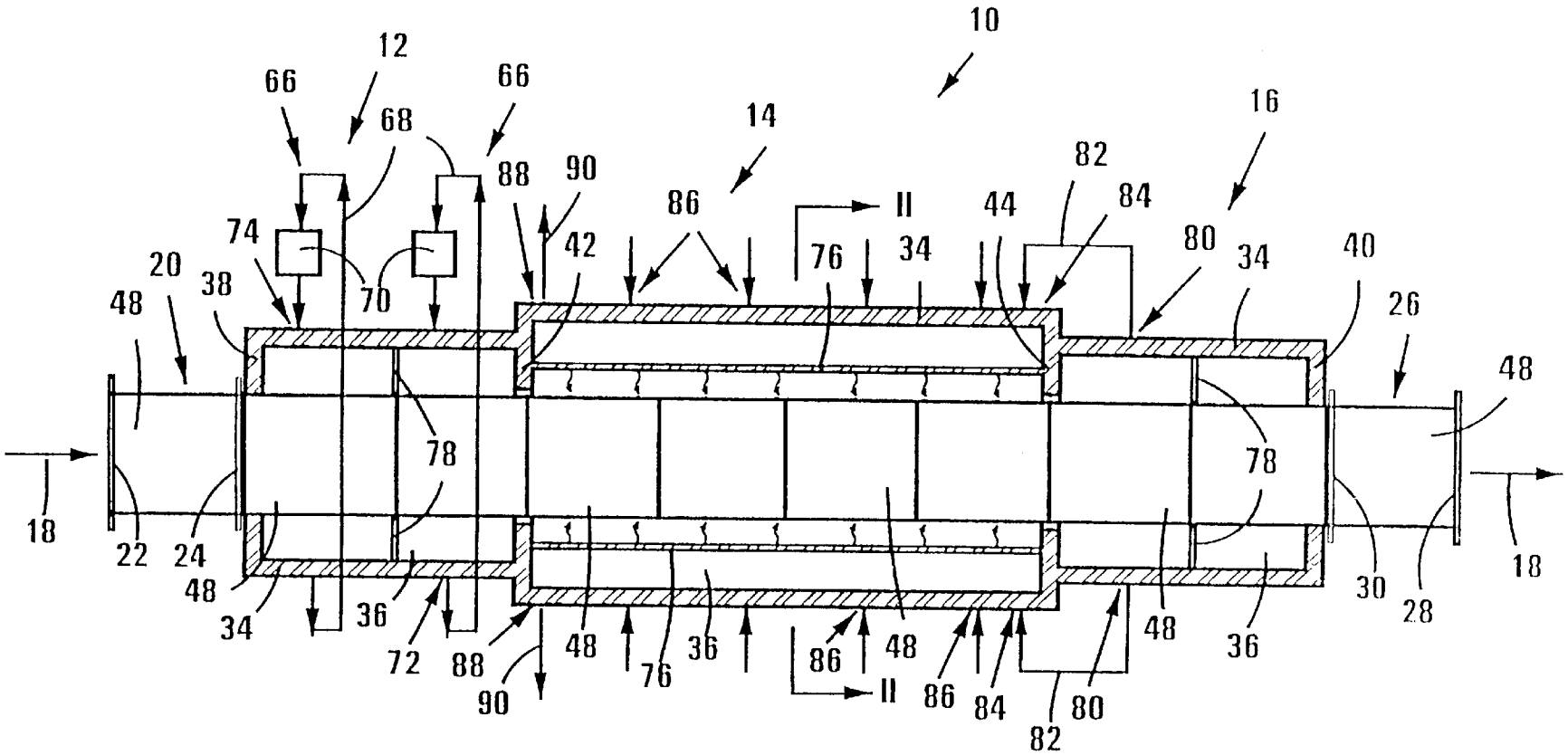
FIG. 1 shows a schematic sectional plan view of an installation in accordance with the present invention, in the direction of line I—I in FIG. 2.

In FIG. 1 of the drawings, reference numeral 10 generally designates a horizontally extending tunnel kiln in accordance with the present invention. The kiln 10 comprises a horizontally extending tunnel divided into three portions, namely an upstream portion 12 defining a heating zone in a hollow interior thereof, a central portion 14 defining a reaction zone in a hollow interior thereof, and a downstream portion 16 defining a cooling zone in a hollow interior thereof. The terms upstream and downstream are used in relation to the movement of mineral along the interior of the tunnel, described in more detail hereunder, and indicated by arrows 18.

At the upstream or inlet end of the kiln there is provided a double-doored airlock 20, having an outer door 22 and an inner door 24, leading respectively to the exterior of the kiln and into the heating zone in the portion 12. Similarly, a double-doored airlock 26 is provided at the outlet or downstream end of the kiln, having an outer door 28 and an inner door 30, leading respectively to the exterior of the kiln and into the cooling zone in the portion 16. Operation of the doors of the airlocks 20 and 26 is interlocked, so that, when the outer door 22, 28 are open, the inner doors 24, 30 are closed, and so that, when the inner doors 24, 30 are open, the outer doors 22, 28 are closed.

Figure 2:
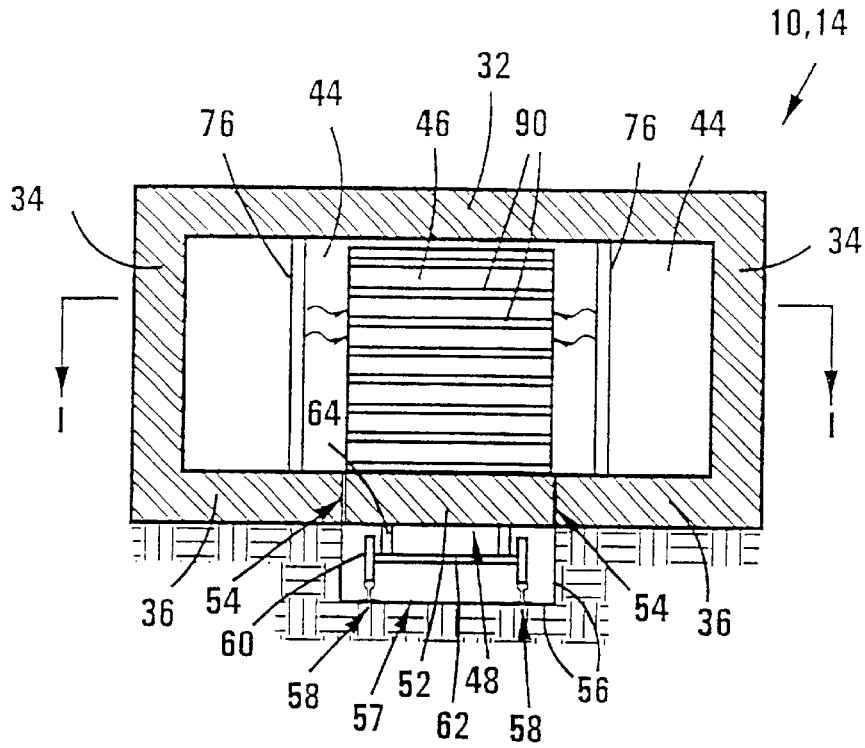
FIG. 2 shows a schematic sectional end elevation of the installation of FIG. 1, in the direction of line II—II in FIG. 1.

The kiln 10 as a whole, and the portions 12, 14, 16, are of broadly similar construction, each having a roof 32 (see FIG. 2), a pair of opposed side walls 34, and a floor 36, as is easily apparent from FIG. 2, which shows a sectional end elevation of the portion 14, and in which the same reference numerals refer to the same parts as in FIG. 1, unless otherwise specified. The portions 12, 16 are of the same width, in a direction transverse to the arrows 18, and are narrower than the width of the portion 14. In other embodiments, the portions 12, 16 need not be of the same width, and if mineral on a train of trolleys in the tunnel is heated from above (see FIGS. 4 and 9 described hereunder), the portions 12, 14 and 16 may all be of the same width. The upstream end of the portion 12 has an end wall 38, through which the door 24 leads; and the downstream end of the portion 16 has a similar end wall 40, through which the door 30 leads.

Figure 3:
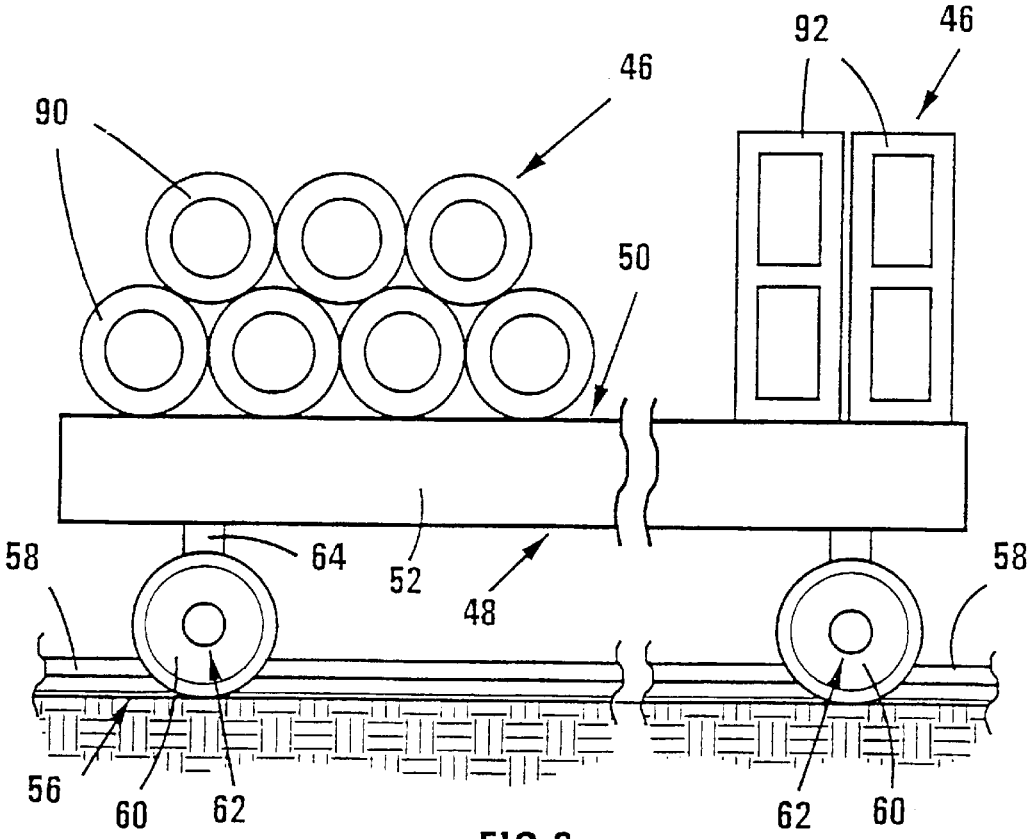
FIG. 3 shows a schematic side elevation of a trolley forming part of the installation of FIGS. 1 and 2, and, stacked on the trolley, extruded shapes formed from a mineral loaded on the trolley.

Walls 42, 44 are provided between the portion 14 and the portions 12, 16 respectively, at least partially separating the reaction zone in the portion 14 respectively from the heating zone in the portion 12 and the cooling zone in the portion 16. The walls 42, 44 each have a central opening of rectangular outline, extending from the floor 36 to the roof 32 for admitting a mineral 46 on wheeled trolleys 48 (see also FIG. 3, in which the mineral and a trolley are respectively designated 46 and 48) from the heating zone to the reaction zone, and from the reaction zone to the cooling zone. In FIGS. 2 and 3 the trolleys 48 are shown with the mineral 46 in place, loaded on upwardly facing surface 50 (see FIG. 3) of a load bed 52 of the trolley 48, whereas in FIG. 1 the mineral 46 is omitted for ease of illustration.

With particular reference to FIG. 2, it is to be noted that the floor 36 has a longitudinally extending slot 54 extending along its length, below the slot 54 is a channel 56, along the floor 57 of which extends a track comprising a pair of laterally spaced rails at 58. The load bed 52 of each trolley 48 is mounted on two longitudinally spaced pairs of wheels 60, the wheels 60 of each pair being mounted at opposite ends of a laterally extending axle 62 on which the load bed 52 is mounted by a pair of brackets 64. The wheels 60 run on the rails 58. The channel 56 is located in the middle of the floor 36, midway between the side walls 34. The roof 32, walls 34 and floor 36 are made of a heat-insulating refractor material, as is the load bed 52 of each trolley 48, which load bed in use registers with opposite sides of the floor 36 and in use fits with a close operating clearance between opposite sides of the floor 36.

The heating zone in the portion 12 is provided with a longitudinally spaced pair of heating circuits, each designated 66. Each circuit comprises a gas flow line 68, a gas heater 70, which is in the form of a gas/gas heat exchanger, and a fan 71 (not shown in FIG. 1). Instead of the gas/gas heat exchanger, a burner, producing combustion gas, can be provided. Each fan is arranged to circulate hot gas from a gas outlet 72 through one side wall 34 of the portion 12, along the flow line 68 in the direction of the arrows in the flow line 68, through the associated gas heater 70, and into a gas inlet 74 through the other side wall 34 of the portion 12. This construction is arranged to cause hot gas to circulate from the gas inlet 74 to the gas outlet 72 across the width of the kiln and across the width of the trolleys over mineral 46 on the trolleys 48 in the portion 12, which in FIG. 1 is capable of holding two trolleys 48, as shown.

The portion 14 is divided by a pair of longitudinally extending partitions 76, which reach upwardly from the floor 36 to the roof 32, into a central longitudinally extending reaction chamber between the partitions 76, and a pair of longitudinally extending combustion chambers, on opposite sides of the reaction chamber, respectively between the reaction chamber and the side walls 34. The partitions 76 are respectively spaced laterally outwardly from opposite sides of the slot 54 and are respectively laterally spaced laterally inwardly of the side walls 34, the partitions 76 being spaced from the mineral 46 on trolleys 48 in the reaction zone.

The heating zone 12 and the cooling zone 16 each have a pair of baffles 78 midway along their lengths. Each baffle 78 reaches upwardly from the floor 36 to the roof 32 and extends transversely inwardly from the adjacent side wall to the edge of the slot 54 in the floor 36, above the channel 56. The cooling zone 16 has a pair of gas outlets at 80, feeding along respective flow lines 82 into the downstream ends of the combustion chambers at 84. The combustion chambers in turn each have a plurality of air inlets 86 spaced longitudinally in series from one another, through the adjacent side walls 34. Each combustion chamber has a combustion gas outlet 88 leading via a flow line 90 to a flare, stack and/or waste heat recovery stage (not shown).

Two trolleys 48 are shown located end-to-end in the cooling zone, as is the case with the heating zone, and four trolleys 48 are end-to-end in the reaction zone. There is a trolley 48 in each airlock 48, and all the trolleys are arranged end-to-end in series, so that the kiln 10 contains a train of end-to-end trolleys 48, consisting of ten trolleys 48.

In FIGS. 2 and 3 consolidated extrusions of mineral 46 to be treated are shown. In FIG. 2 and at the left-hand side of FIG. 3 the extrusions are in the form of extruded pipes 90, while at the right-hand side of FIG. 3 the extrusions are shown in the form of rectangular hollow blocks 92 (described in more detail hereunder with reference to FIGS. 6 and 7).

In use, the tunnel kiln 10 of FIGS. 1–3 will usually be used for a process according to the invention for the treatment of minerals undergoing an endothermic reaction, typically under reducing conditions and at an elevated temperature, examples being the pre-reduction of chromite and the nitriding of titanium dioxide.

In accordance with the process of the invention and with reference initially primarily to FIGS. 1–3, when the endothermic reaction is a reduction reaction, the mineral to be reduced and a suitable reductant, such as a particulate carbonaceous material, will typically be milled and intimately mixed prior to the reduction. The reductant may thus be coal, and criteria for reductant selection will usually include cost, fixed carbon content, volatile matter content, the ash fusion temperature and the ash composition of the residual ash derived from the reductant.

After the mineral and reductant are milled and mixed, the mixture may be loaded on trays which are stacked on kiln cars such as the trolleys 48 illustrated in the drawings. Instead, the mixture can be consolidated by extrusion or moulding into desired shapes, constituents such as binders and fluxes (for example calcium fluoride) being admixed into the mixture before the extrusion, for facilitating the extrusion (the binder) and enhancing the reaction between the mineral and the reductant (the flux). The extruded shapes may be loaded on trays stacked on the trolleys 48, or may be stacked directly on the load beds 52 of the trolleys.

Once the trolleys 48 are loaded with the reaction mixture, they are introduced intermittently and in sequence into the kiln via the airlock 20 which is operated to prevent the doors 22, 24 from being open simultaneously, so as to resist egress of reducing atmosphere and of any combustible gases from the interior of the kiln 10. Introduction of each trolley pushes a train of trolleys ahead of it, and is associated with the simultaneous withdrawal of a trolley at the downstream end of the train from the airlock 26 which is similarly operated so that its doors 28, 30 are not simultaneously open.

When the trolleys 48 are in the heating zone in the portion 12 (two trolleys are shown there) they are pre-heated by forced convection by the circuits 66, hot gas being circulated in the interior of portion 12 from the gas inlets 74 to the associated gas outlets 72, and passing over the mineral 46 in the reaction mixture on the trolleys 48.

By having the reaction mixture on trays with suitably selected spacings between them, or by using consolidated extrusions having shapes and packing geometries selected to provide suitable openings, pressure drops across the heating zone in the portion 12 can be kept sufficiently low for fans to be used for heating gas circulation, rather than blowers. The degree of heating achieved in the heating zone will typically be a function of the length of the heating zone and of the number of heating circuits 66, so that there is a sufficient residence time to achieve a desired temperature increase, the maximum temperature being set by the temperature limits of the fans forming part of the circuit 66. Typical limits are expected to be 800–900° C. Further heating, above these temperatures, is achieved in the reaction zone in the kiln portion 14, by radiant heating as described hereunder.

In the arrangement illustrated in FIGS. 1–3 of the drawings, which is suitable for chromite pre-reduction, and using coal as a reductant, combustible gases such as carbon monoxide and volatile organic vapours are released from the reaction mixture during the pre-heating and/or during the reduction reaction. It is not desirable to burn these gases in the reaction chamber in the kiln portion 14, to supply energy for the reduction reaction, because any carbon dioxide formed can reoxidize the reduced mineral (chromite) when its partial pressure is sufficiently high. Instead, in accordance with the present invention, carbon monoxide-rich off-gas from the reduction reaction is withdrawn from the cooling zone in the portion 16 of the kiln, at 80, and thence along flow lines 82, to be fed into the combustion chambers at 84. Combustion then takes place in the combustion chambers of the kiln portion 14, between its walls 34 and the partitions 76. While the partitions can be air-tight and impermeable, minor gas leaks therethrough can be tolerated, provided that the reaction chamber between the partitions 76 is at a sufficiently higher pressure than the pressure in the combustion chambers, which pressure differential should be maintained if the partitions 76 are not air-tight, for no unacceptable reoxidation to take place in the reaction chamber. Heat from the combustion in the combustion chambers is transferred from hot combustion gases in the combustion chambers to the partitions 76, and is then radiated from the partitions 76 on to the reaction mixture carried by the trolleys 48 in the portion 14.

Efficient radiant heat transfer from the partitions 76 to the reaction mixture can be facilitated by suitable spacing of trays on which the reaction mixture is loaded and/or by the selection of extruded shapes and stacks thereof to promote radiant heating. In each case relatively large unobstructed openings are desirable and should be encouraged by the stacking of the reaction mixture or extrusions on the trolleys 48. Heat transfer to the reaction mixture takes place via radiation from the partitions 76 into the stacks on the trolleys, via openings formed for this purpose in the stacks in question.

As the reaction mixture moves along the reaction zone in the section 14, it is heated by radiation to the required reaction temperature, and reduction of the mineral, such as chromite, occurs. The residence time of the mineral in the reaction zone is selected in accordance with the mineral to be reduced, the type of reductant such as coal used, the proportion of reductant in the reaction mixture, the particle sizes to which the mineral and reductant have been milled, the nature and proportion of any additives such as binders and fluxes used, the thickness of any layers or extrusions of reaction mixture in the stacks, the physical dimensions and shapes of the stacks, the temperature of the partitions 76 and the nature of the (reducing) atmosphere in the interior of the portion 14 of the kiln 10.

After the mineral has been reacted and reduced, the reacted material is moved through the cooling zone in the portion 16 before it is withdrawn from the kiln via the air lock 26. If desired, heat can in principle be recovered from the cooling zone in the portion 16, depending on the cost of energy and the cost of suitable heat-recovery equipment.

When more complex endothermic reactions take place, such as the nitriding of titanium dioxide, in which case the mineral is intended both to be reduced and nitrided, off-gas for combustion in the combination chambers of the portion 14 can be withdrawn from the interior of the kiln at a position (not shown) between the heating zone in the portion 12 and the reaction zone in the portion 14 and provision can be made, in the case of nitriding, for nitrogen to be introduced into the reaction zone in the portion 16 at a suitable position (not shown), for preheating thereof in portion 16 and for cooling the solid reaction product in the portion 16 under nitrogen, before the preheated nitrogen flows countercurrently into the reaction zone in the portion 14, to nitride the titanium dioxide there. In this regard it will be appreciated that the air inlets at 86 are illustrated for introducing oxygen for the combustion of off-gas in the combustion chambers.

Furthermore, instead of using off-gas directly from the cooling zone in the section 16 for combustion, gas from the cooling zone may be withdrawn, cleaned, cooled and stored before it is used for combustion later (not illustrated).

It is expected that suitable high temperature-resistant refractory materials such as refractory bricks can be used for the partitions 76. Instead, refractory materials such as silicon carbide may be preferred, as they exhibit relatively reduced resistance to heat transfer by virtue of higher thermal conductivity, and have relatively high strength, permitting lower wall thicknesses.

Features of the invention with particular reference to FIGS. 1–3 are that the process permits the avoidance or at least a reduction in the use of kiln furniture, which may be expensive, by the use of extruded shapes containing both the mineral to be reduced, and the necessary reductant. Efficient radiant heat transfer from heating surfaces to selected extruded shapes containing mineral and reductant stacked on trolleys is promoted, and the process permits the use of carbon monoxide-rich off-gas for combustion. This off-gas may be derived from the reaction mixture of mineral and reductant, and may be used to heat the heating surfaces which radiate heat on to the reaction mixture. Combustion gases are kept separate from, and prevented from coming into contact with, minerals being reduced, so that re-oxidation of the minerals is resisted. It is also, as indicated above, in principle possible to recover heat from waste gas, for example by using it to pre-heat air required for combustion in the combustion chambers, or by generating steam in a waste heat boiler (not illustrated).

The extruded shapes illustrated in FIG. 3 are selected and stacked on the trolleys to promote low pressure drops in gases being circulated by the circuits 66 in the portion 12 for forces convective heating purposes, and have relatively large interior openings, promoting relatively unobstructed radiation paths for radiant heat transfer to the extrusions from the partitions 76. In particular, the extrusions are selected to reduce or avoid the use of expensive kiln furniture required for the stacking of trays on the trolleys, leading to reduced capital cost and reduced maintenance cost. Heat wasted on heating inert material such as kiln furniture is reduced or avoided.

Furthermore, it has been found that, even if the reaction temperature required for reduction is above the melting point of the mineral to be reduced, the mixing and extruding of the mineral with a non-melting constituent such as carbon used as the reductant, can result in a solid extrusion that is more clay-like at high temperatures than liquid. This clay-like extruded mixture can have sufficient mechanical strength to facilitate stacking of extrusions to sufficient heights to allow the use of extruded reaction mixtures, rather than powder reaction mixtures carried on stacked trays and employing undesirable kiln furniture.

It is expected that, for each application, the shapes and dimensions of extruded reaction mixtures can in principle be optimized. For example, with regard to optimization of wall thickness of extrusions, thicker walls promote stacking of high stacks of extrusions with reduced kiln furniture requirements, but at the penalty of longer residence times necessary to achieve desired reduction and hence larger and more expensive kilns. Routing experimentation will thus be employed for such optimization, practical and economic considerations being borne in mind.

Figure 4:
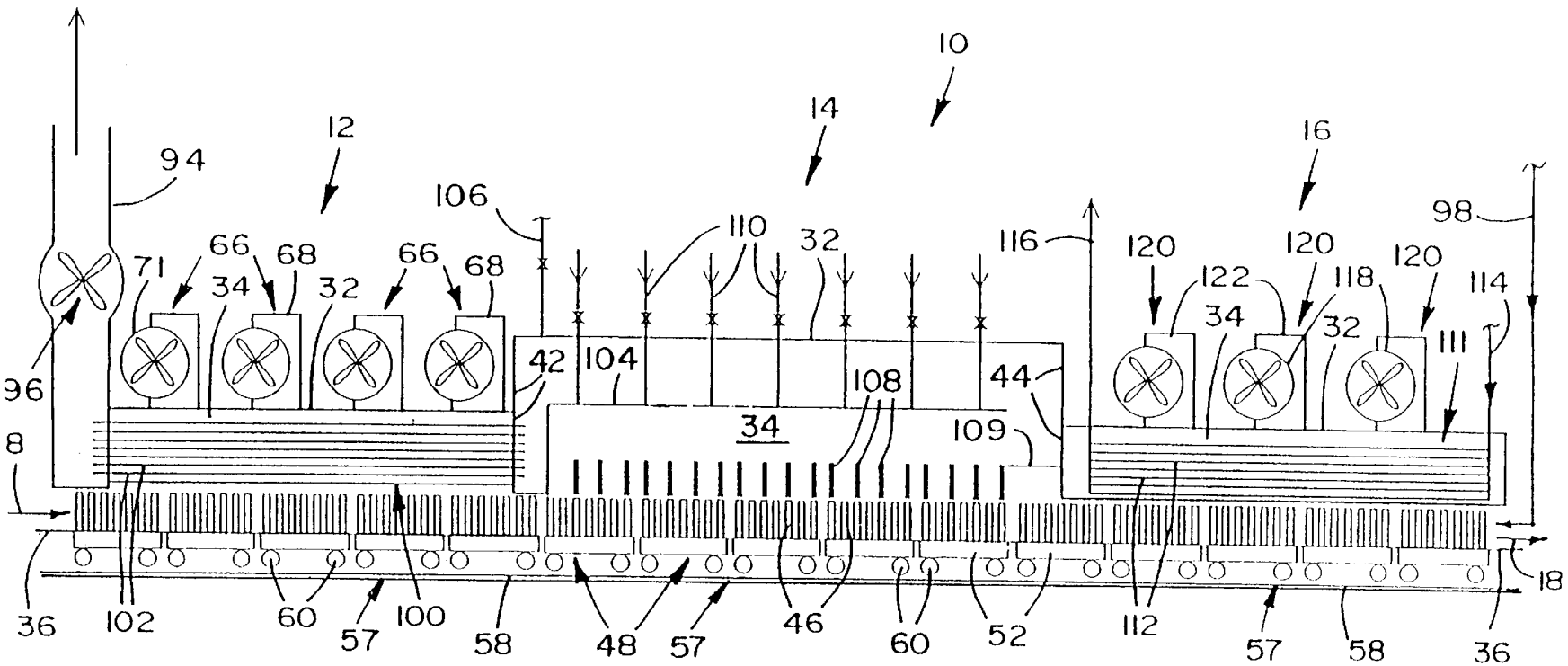
FIG. 4 shows a schematic partial sectional side elevation of a variation of the installation of FIG. 1.

Turning to FIG. 4, in which a variation of the construction of FIGS. 1–3 is illustrated, the same reference numerals are used for the same parts, as in FIGS. 1–3, unless otherwise stated. In FIG. 4 the airlocks 20 and 26 are omitted for ease of illustration, and a train of trolleys 48 is shown supported by their wheels 60 on the rails 58 on the floor 57 of the channel 56 (see FIG. 2). Spaced stacks of consolidated mineral 46 are shown on the load beds 52 of the trolleys 48.

In FIG. 4 an exhaust gas stack 94 is shown at the trolley inlet end portion 12. This stack contains an induced draft extraction fan 96, for withdrawing gases from the interior of the kiln 10 containing the trolleys 48. A feed line 98 is shown for feeding inert gas into the trolley outlet end of the kiln 10, eg nitrogen to counteract any reoxidation of reduced minerals 46 in the portion 16 of the kiln 10.

In the portion 12 of the kiln 10 of FIG. 4 is shown, instead of the gas heaters 70, a heat exchanger 100 comprising a bank of tubes 102 which receive combustion gases from the portion 14 and feed them into the stack 94. The fans 71 are illustrated in FIG. 4 and are shown blowing gas from the gas outlets 72 (FIG. 1) over the tubes 102 to heat the gas, and then blowing it into the gas inlets 74 (FIG. 1) and across the mineral 46 on the trolleys 48, to preheat the mineral.

In FIG. 4, unlike FIG. 1, the mineral is heated by radiation from above. The partitions 76 and combustion chambers on opposite sides of the trolleys of FIG. 1 are omitted from FIG. 4 and are replaced by a combustion chamber above the trolleys. This combustion chamber has a partition 104, spaced above the mineral 46 on the trolleys, the combustion chamber being defined above the partition 104 and below the roof 32 of the kiln. The combustion chamber is provided with a cooling air supply line 106 adjacent the portion 12 and feeds into the tubes 102 of the heat exchanger 100. Instead of the partition 104, baffles 108 may be employed in the combustion chamber above the mineral 46 on the trolleys. These baffles 108 are described hereunder with reference to FIGS. 14 and 15. However, for ease of illustration, a plurality of such baffles 108 is illustrated in FIG. 4, in the combustion chamber immediately above the mineral 46 on the trolleys 48. These baffles 108 are spaced in series from one another in the longitudinal direction of the kiln and extend horizontally across the width of the kiln, between the walls 34. The baffles 108 have lower edges spaced closely above the mineral 46 and upper edges spaced below the roof 32 of the combustion chamber, to leave a combustion space above the baffles 108 and below the roof 32. A horizontal panel 109 adjacent the wall 44 acts to define a duct or passage feeding upwardly past the end of the partition 104 adjacent the portion 16, into the combustion chamber above the partition 104 and below the kiln roof 32. Combustion air feed lines 110 are shown feeding through the roof 32 of the kiln 10 and into the combustion chamber, the lines 110 being spaced along the length of the roof 32.

Turning to the portion 16 of the kiln 10 of FIG. 4, the cooling zone in the portion 16 is provided with a heat exchanger 111 above the train of trolleys 48, comprising a bundle of heat exchange tubes 112. The heat exchanger 111 has a coolant supply line 114 for supplying eg cooling water to it, and a discharge line 116 for withdrawing hot coolant therefrom. Three fans 118, spaced along the length of the portion 16, each form part of a cooling circuit 120, having a gas flow line 122 associated therewith, in a construction similar to that of the heating circuits 66 of the portion 12.

In use, as with FIG. 1, the heating circuits 66 are used to circulate heated gas (gases evolved during the preheating such as water vapour, volatiles from the reductant used, and carbon monoxide) over the stacks 46 of mineral on the trolleys 48 in the portion 12. A high flow rate of heating gas is desirable, of the same order of magnitude in gas mass flow rate terms as the mass flow rate of mineral along the kiln. Thus a sufficiently large number of fans 71 can be used to circulate heating gas across the trolleys 48 and stacks 46, in a direction perpendicular to the direction of travel of the trolleys 48, relatively little gas passing from any one fan 71 to either of the adjacent fans 71. To reduce passage of heating gas from any fan 71 to adjacent fans, adjacent fans may be arranged to circulate gas alternately in opposite directions across the trolleys 48 of the train. It will be appreciated that these features apply equally when the heating gas is heated by gas heaters 70 (FIG. 1) instead of the heat exchanger 100. When the heat exchanger 100 is employed, and if the combustion gases from the portion 14 entering the heat exchanger are hot enough, excess oxygen can be added thereto, to reduce the carbon monoxide content in the exhaust gas, in the stack 94.

Naturally, if heat produced by combustion of volatiles (from the reductant mixed with the mineral) in the combustion zone in the portion 14 is not sufficient to drive the reduction or other endothermic reaction in the portion 14, additional fuel and air/oxygen may be fed to the combustion zone for the evolution of heat by combustion for this purpose, and/or for the purpose of heating the mineral in the portion 12. If (as described hereunder with reference to FIG. 9) hot gas from the reaction zone is circulated directly over mineral in the portion 12, and/or if a heat exchanger 100 is used as shown in FIG. 4, an additional fuel such as methane, low pressure gas (LPG) or carbon monoxide, with additional air for the combustion thereof, can be added directly to the combustion gas passing from the portion 14 to the portion 12 for preheating mineral in the portion 12. It is in principle possible, if desired, when heating the mineral in the stacks 46 in the heating zone in the portion 12, to use combinations of the aforegoing heating methods, eg using the heat exchanger 100 with the gas heaters 70 (FIG. 1), or either the heat exchanger 100 or gas heaters 70 with direct gas heating by passing hot gas over the stacks 46 (FIG. 9), or all three heating methods (exchanger 100, heaters 70 and direct hot gas heating) can be used together.

According to a further feature of the process of the present invention, it may be desirable to operate the fan 96 so that it acts to reduce pressure in the portion 14 sufficiently for gas flow to take place into the trolley feed end of the portion 12 and from the portion 12 into the portion 14. Thus, when a reductant such as coal is mixed with the mineral in the stacks 46, and releases volatiles during heating thereof in the portion 12, these volatiles may be sucked and swept from the portion 12 into the portion 14, for reforming thereof in the portion 14, so that volatiles will not condense on kiln surfaces. If, on the other hand, the volatiles are not reformed in the portion 14, they preferably should be removed from the kiln in a gas stream located at a position where the temperature of this gas stream is high enough to prevent such condensation, and is high enough to cause combustion of the volatiles if air is added to the gas stream.

The combustion zone in the portion 14 is above the partition 104 and below the rood 32. Radiation to the stacks 46 in the portion 14 will be from the partition 104 in the combustion chamber. To improve combustion and reduce air or oxygen consumption, it may be desirable to preheat such combustion air or oxygen to obtain the required elevated temperatures in the combustion chamber. This preheating can be effected by heat exchange with exhaust gases in the stack 94 or with gases leaving the combustion chamber.

In the cooling zone in the portion 16 of the kiln 10 of FIG. 4, coolant such as water from line 114 is passed along the tubes 112 of heat exchanger 111 and leaves the heat exchanger 111 as hot coolant along line 116. The fans 118 circulate gas (principally inert gas from line 98 but including gas and volatiles given off by the stacks 46 on the trolleys 48 in the portion 16) across the tubes 112 of the heat exchanger 111, to cool this gas. The cooled gas is circulated by the fans 118 along the gas flow lines 122 of the cooling circuits 120 and across the stacks 46 to cool the mineral of the stacks 46.

In variations of what is shown in FIG. 4, the heat exchanger 111 can be used as a boiler to boil water used as a coolant, for steam generation. Air can instead be used as the coolant of the heat exchanger 111, the heat exchanger acting to preheat this air, eg for use of the preheated air in the combustion in the portion 14. A further possibility is for heat absorbed by coolant in the cooling zone in the portion 16 to be used to heat mineral in the heating zone in the portion 12, the hot coolant being used as a heating fluid in the portion 12.

Figure 5:
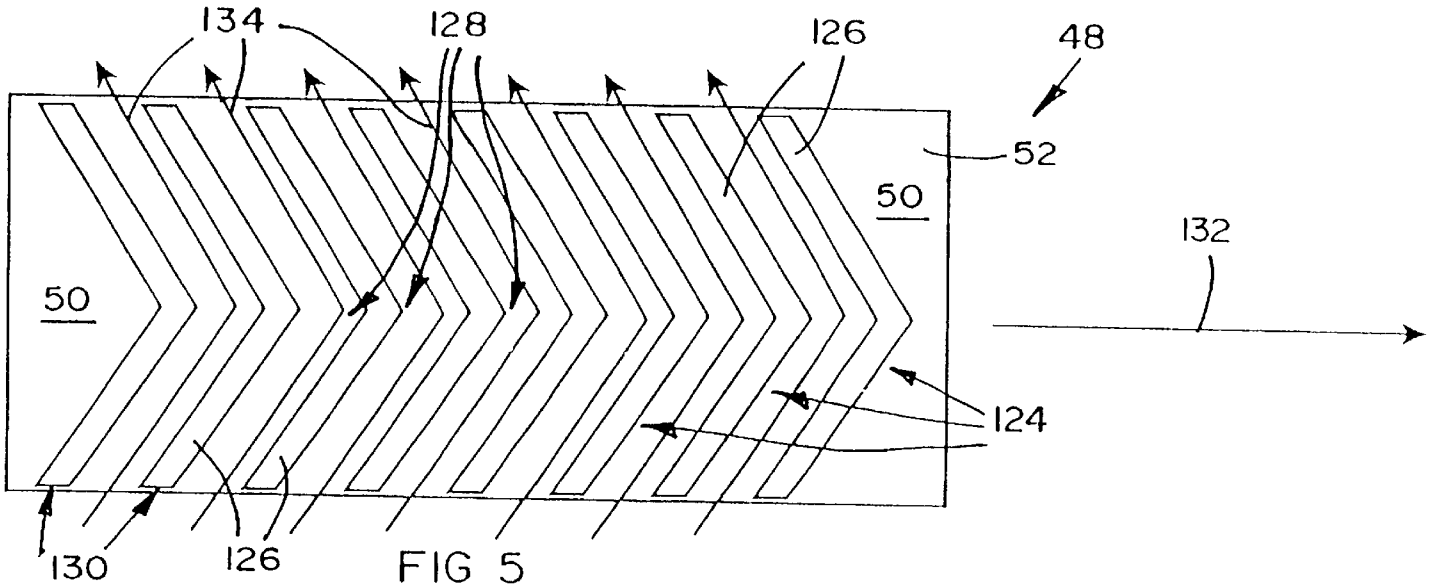
FIG. 5 shows a schematic plan view of chevron-shaped consolidation mineral shapes stacked on a trolley load bed.

In FIG. 5 a load bed 52 of a trolley 48 is shown carrying a plurality of chevron-shaped consolidated shapes 124 of mineral and reductant. The shapes 124 are each made up of a pair of roughly rectangular slabs 126. The slabs 126 of each shape 124 intersect at a corner 128 at the inner edges of the slabs, the slabs having outer edges at 130 and having side edges extending between their inner edges at the corners 128 and their outer edges 130. In use the shapes 124 are stacked on the flat upper surface 50 of the load bed 52 on the side edges of the slabs 126, in stable fashion, in a spaced, roughly nesting arrangement, in series along the length of the load bed 52 as shown in FIG. 5, which is elongate rectangular in plan view outline. Gas flow across the stacked shapes 124 on the load bed 52, perpendicular to the direction of travel of the trolley 48 shown by arrow 132, is shown in turn by arrows 134. This is gas flow caused by the fans 71 (FIG. 4) and the shapes tend to resist gas flow in the direction of arrow 132. Radiation can still enter, from above or from the sides, in the portion 14, to heat the faces of the slabs 126.

Figure 6:
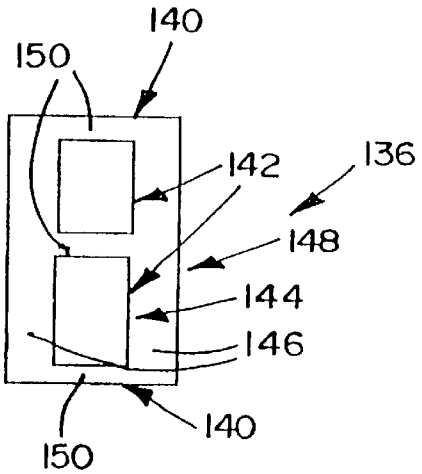
FIGS. 6 and 7 show respectively a plan view and a side elevation of a hollow block consolidated mineral shaped for use in the process of the invention.
Figure 7:
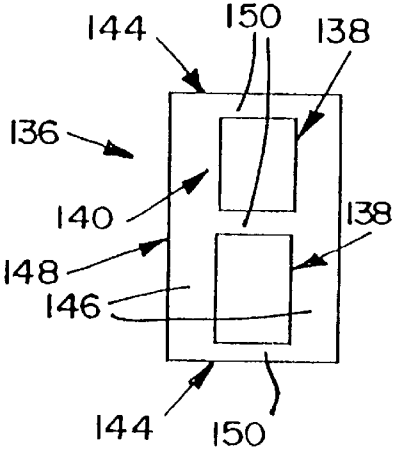

FIGS. 6 and 7 show respectively a plan view and a side elevation of a consolidated shape, generally designated 136, of mineral and reductant. As is apparent from FIGS. 6 and 7, the shape 136 is a block whose plan view is similar to its side elevation, both views being essentially edge-on. The shape is a block having a hollow interior into which open a pair of windows 138 through each of its side edges 140, and into which open a pair of windows 142 through each of its top and bottom edges 144. Each shape 136 comprises a pair of spaced registering, square slabs 146 having a flat outer surface 148, the slabs being spaced apart by struts or spacers 150, there being a strut or spacer at each slab corner, and one midway along each slab edge. When these shapes 136 are stacked on the upper surface 50 of the load bed 52 of a trolley 48 in the fashion of the shapes 92 of FIG. 3, gas can flow through the hollow interiors of the shapes, across the trolley via the windows 138. Radiant heat from above can radiate into the interior of the shape 136 form above, via the windows 142 in its top edge 144. As the blocks have the same outline and windows, both in plan view and in side elevation, stacking thereof on trolleys is facilitated, as any edge can act as either a side edge, or as a top to bottom edge.

Figure 8:
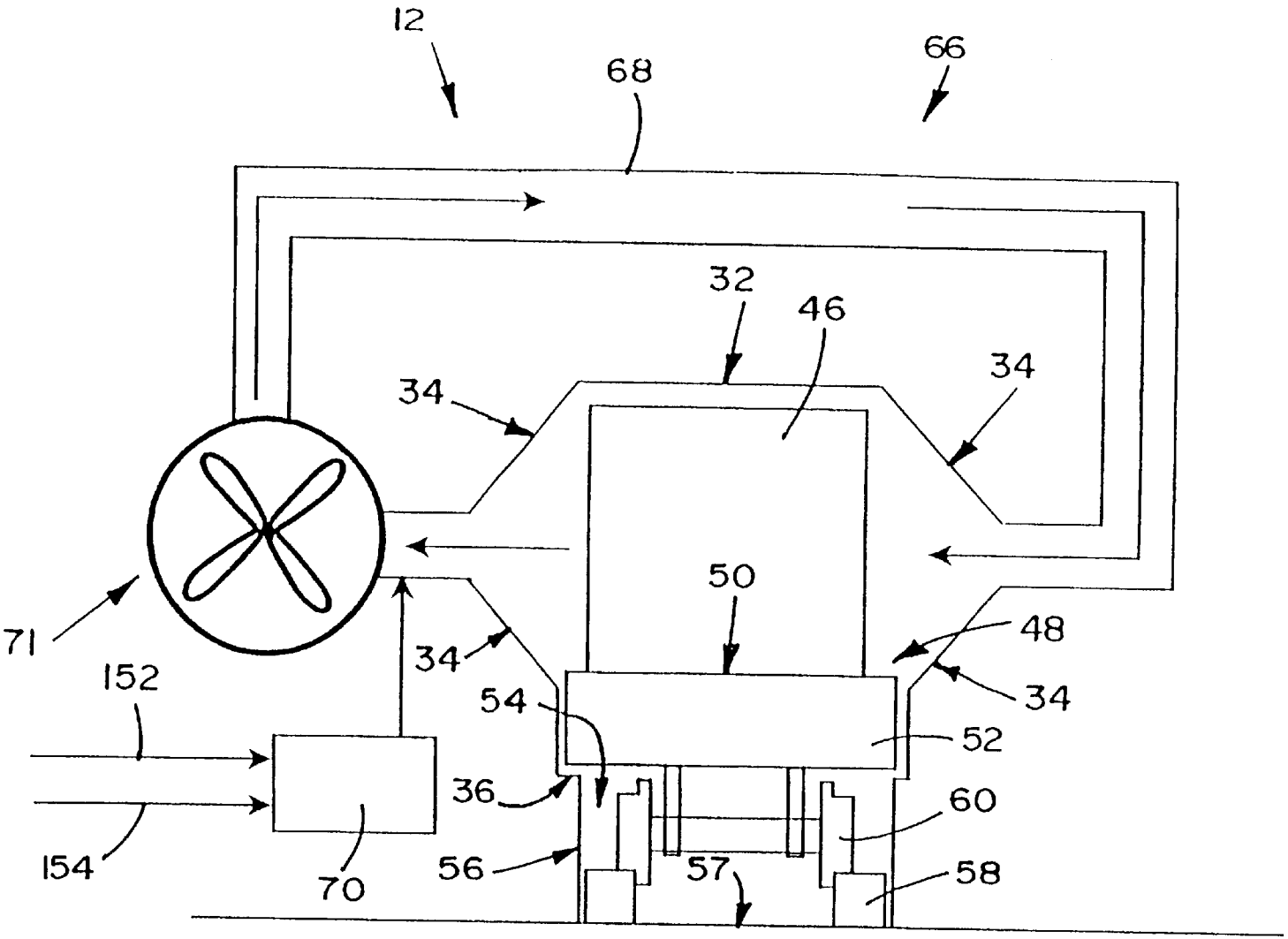
FIG. 8 shows a schematic sectional end elevation of the heating zone of a variation of the installation of FIG. 4.

Turning to FIG. 8 of the drawings, the same reference numerals are used as in FIGS. 1–7 of the drawings, unless otherwise specified, for the same parts. A fan 71 is shown blowing heating gas from a gas heater 70 in the form of a combustion box along the gas flow line 68 of a heating circuit 66. The combustion box 70 is fed by an air supply line 152 and by a combustion gas supply line 154, leading from the combustion zone in the portion 14, above the trolleys 48. The gas circulated through the portion 12 by the fans 71 preferably has a composition such that carbon monoxide therein is in equilibrium with carbon dioxide therein or such that there is an excess of carbon monoxide, the equilibrium being represented by the Boudouard reaction:

$$C+CO_2 \leftrightarrows 2CO$$

Any excess carbon dioxide in the combustion gas will in this case react with carbon in the reductant in the mineral stacks 46, decreasing the amount of the carbon reductant available for the reduction. Thus, additional carbon can be admixed with the mineral to compensate for this, if the combustion gas used has excess carbon dioxide.

Instead of supplying combustion air to the combustion box, and if combustion gas from the combustion zone in the portion 14 is produced at a mass rate similar to the mass flow rate of mineral in the stacks 46 along the kiln, it may be possible to omit the gas heater or combustion box 70 and simply blow the combustion gas directly across the stacks 46 (see FIG. 9) the fans 71 merely feeding the combustion gas from the line 154 into and along the circuits 66.

Figure 9:
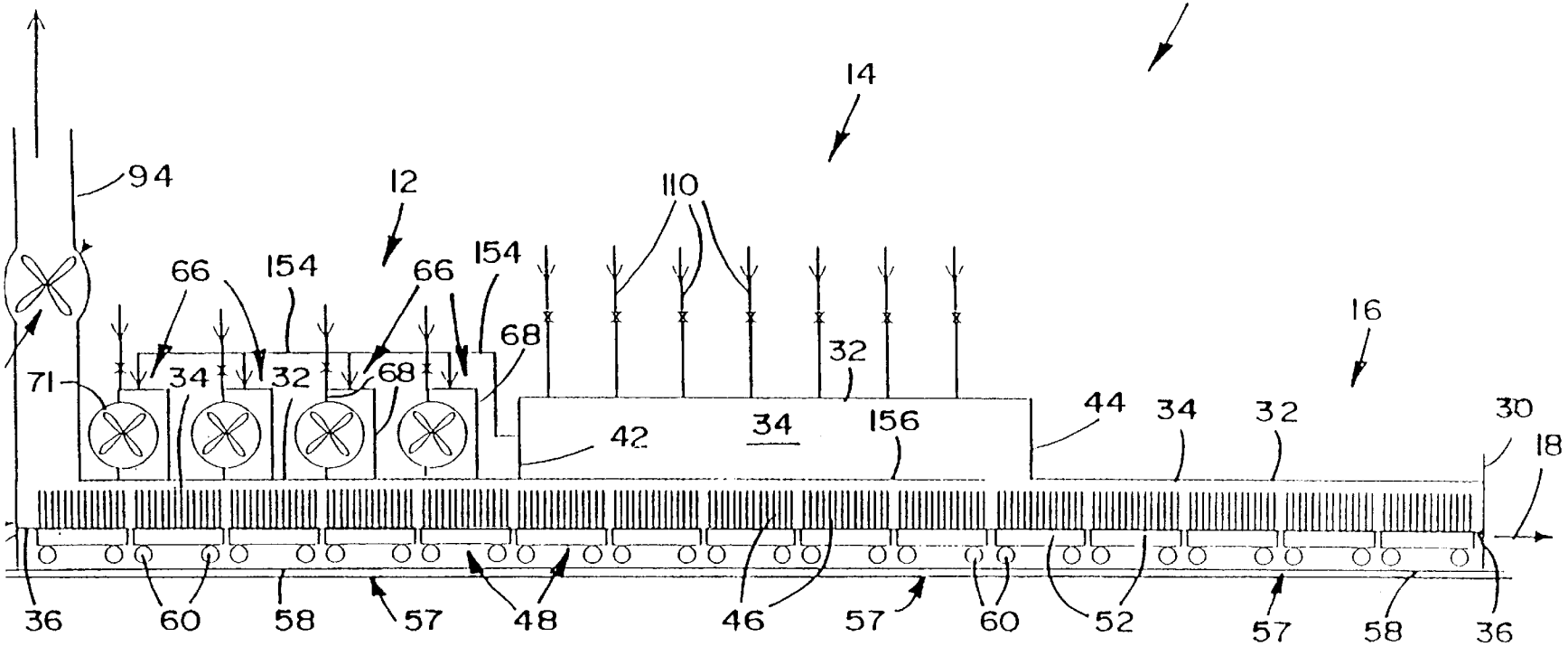
FIG. 9 shows a view similar to FIG. 4 of a variation of the installation of FIG. 4.

FIG. 9 shows a variation of the construction shown in FIGS. 1 and 4 and, once again, the same reference numerals represent the same parts, unless otherwise specified. In FIG. 9, the heat exchanger 100 (see FIG. 4) of the portion 12 is omitted, and there is also no gas heater or combustion box 70 (see FIG. 8). Instead, the fans 71 of the circuits 66 withdraw combustion gas directly from portion 14 via flow line 154, and circulate it directly along lines 68 and over the stacks 46 in the portion 12. The mass flow rate of gas flowing along line 154 from portion 14 is similar to the mass flow rate of mineral in the stacks 46, along the portion 12 and no air (see line 152 in FIG. 8) is added to this combustion gas. Turning to the portion 14 in FIG. 9, combustion takes place in a combustion chamber above the stacks 46, between a partition 156 (which is closer to the stacks 46 than the partition 104 of FIG. 4) and the roof 32 of the portion 14, and radiant heat is radiated from the partition 156 downwardly between and on to the stacks 46. Combustion air enters the portion 14 along lines 110 and combustion gas leaves it via line 154.

Figure 13:
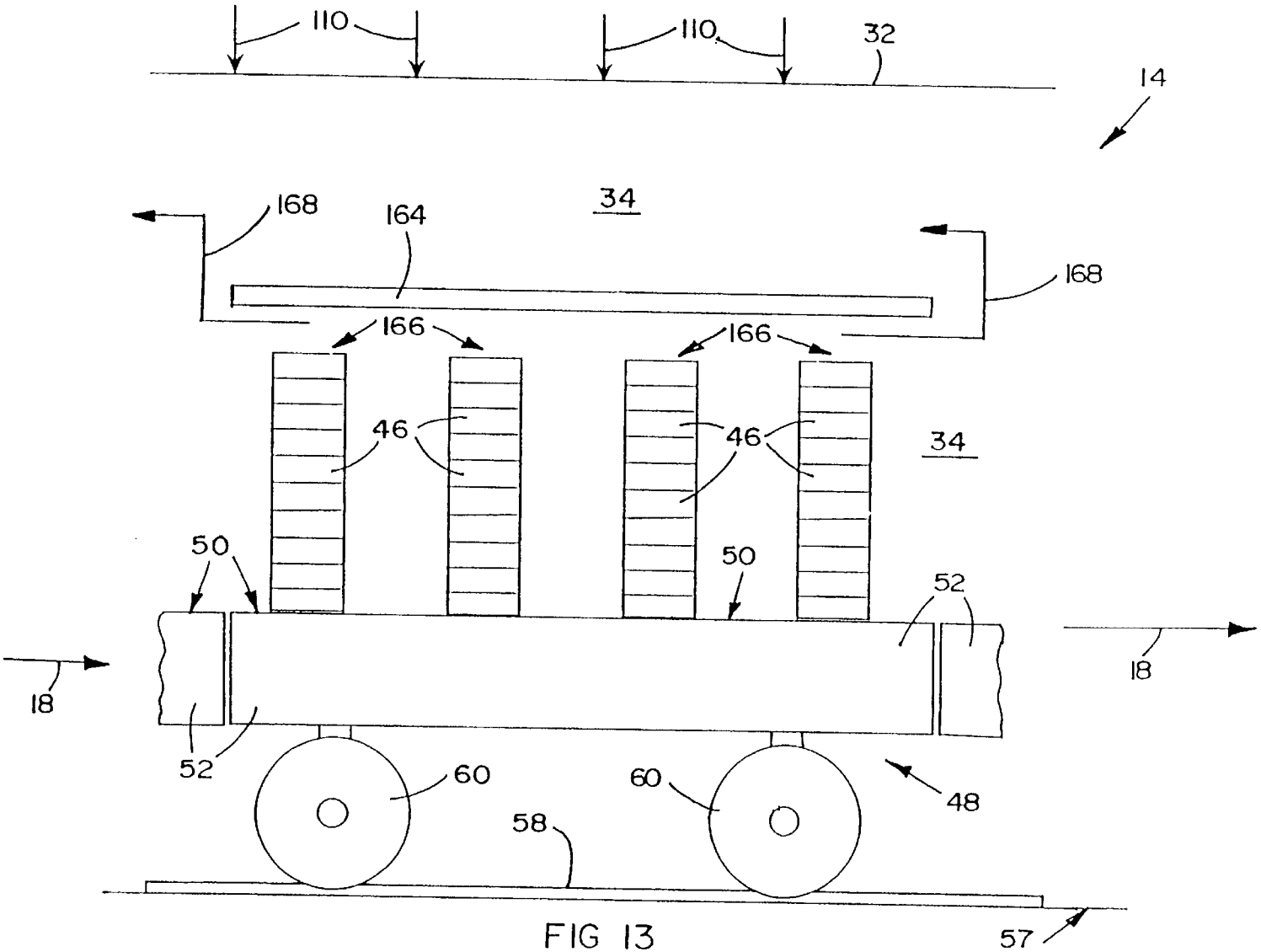
FIG. 13 shows a schematic side elevation of a trolley carrying stacks of consolidated shapes and a partition panel of refractory material thereon.

It should be noted that, as described in more detail hereunder with reference to FIG. 13, instead of the partition 156, each trolley 48 may have a panel of refractory material such as silicon carbide laid flat on top of the stacks 46 on the trolley. These panels (not shown in FIG. 9 but see 164 in FIG. 13) will pass along the kiln in the direction of arrow 18 on the respective trolleys, from the trolley inlet end of the kiln to its outlet end, and can be recycled for re-use from the trolley outlet end to the trolley inlet end. These panels can be placed on a layer of powder such as coal on the stacks, to resist sticking thereof to the stacks; and an advantage thereof is that any breakage thereof can be cured by simple replacement thereof, unlike breakage of the partition 156, which can lead to down-time of the kiln 10. They otherwise function similarly to the partition 156 by radiating heat downwardly between and on to the stacks 46, while keeping carbon dioxide away from the stacks 46.

Turning to the portion 16 of the kiln of FIG. 9, this differs from that of FIG. 4 by omitting the cooling circuits 120 and by omitting the heat exchanger 111. Instead, the roof 32 of the portion 16 is closely spaced above the stacks 46, and no attempt is made to cool the stacks 46.

Although operation of the kiln 10 of FIG. 9 as described above contemplates no air addition to the gas of line 154 (see air line 152 in FIG. 8 in contrast), there is a possibility of adding some air to the fans 71 closest to the exhaust stack 94. This added air is to keep the $CO:CO_2$ volume ratio at or close to that corresponding to the Boudouard equilibrium concentrations at the temperature of the stacks 46. Heat energy in the combustion gas can thus be used to burn carbon monoxide to carbon dioxide, in equilibrium conditions which are such that fine carbon soot will not be formed in terms of reversal of the Boudouard reaction.

It should also be noted that it is environmentally desirable to have little or no carbon monoxide passing up the stack 94, and adding air to the combustion gas promotes this aspect.

Operation of the kiln 10 of FIG. 9 contemplates keeping the stacks 46 hot for feeding them in a hot condition onwards for further processing. For example, if the process and kiln are used for the pre-reduction of chrome ore, energy can be saved by transferring the material of the stacks 46 in a hot state from the kiln 10 to a furnace such as an arc furnace for final reduction and slag separation. This transfer would take place, as far as possible, under a reducing environment to resist re-oxidation of the hot mineral. As a development of this possibility, it may be desirable to employ thin-walled shapes to make up the stacks 46, to permit direct transfer of the mineral of the stacks to a smelter or the like, without any milling or size reduction of the mineral.

On the other hand, if cooling such as is contemplated by FIG. 4 is employed (see cooling circuits 120 and heat exchanger 111), it may be desirable to cool the stacks 46 using the least expensive means, without trying to recover any heat, as the heat source such as coal, will typically not be expensive.

Figure 10:
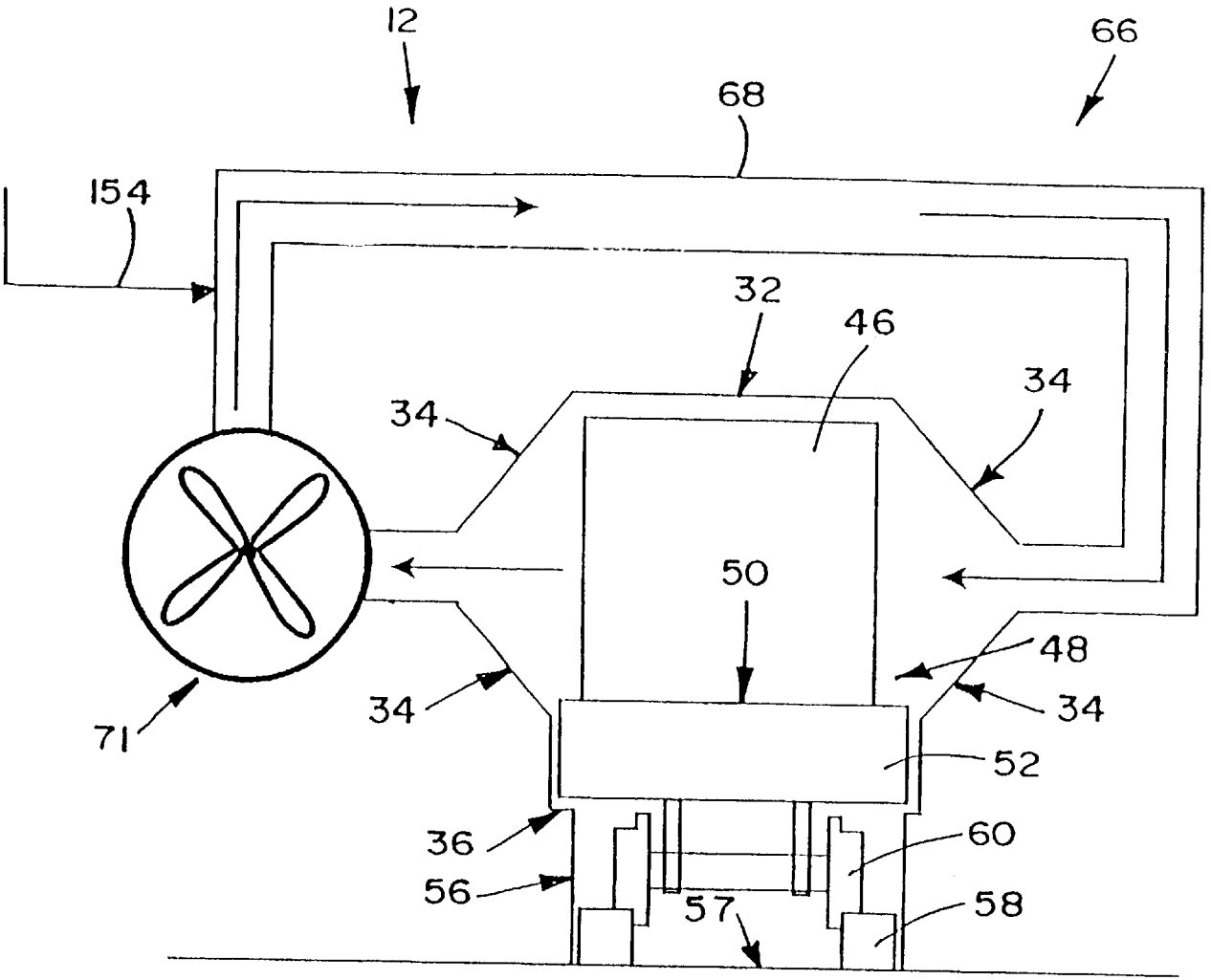
FIG. 10 shows a view similar to FIG. 8 of a variation of the heating zone of FIG. 8.

In FIG. 10 the same reference numerals are used to designate the same parts as in FIG. 8, unless otherwise specified. In FIG. 10, unlike FIG. 8, the combustion box 70 and air feed line 152 are omitted, and the combustion gas feed line 154 feeds directly into the line 68. The fan 71 thus circulates combustion gas from portion 14 and line 154, directly over the stacks 46 on the trolleys 48.

Figure 11:
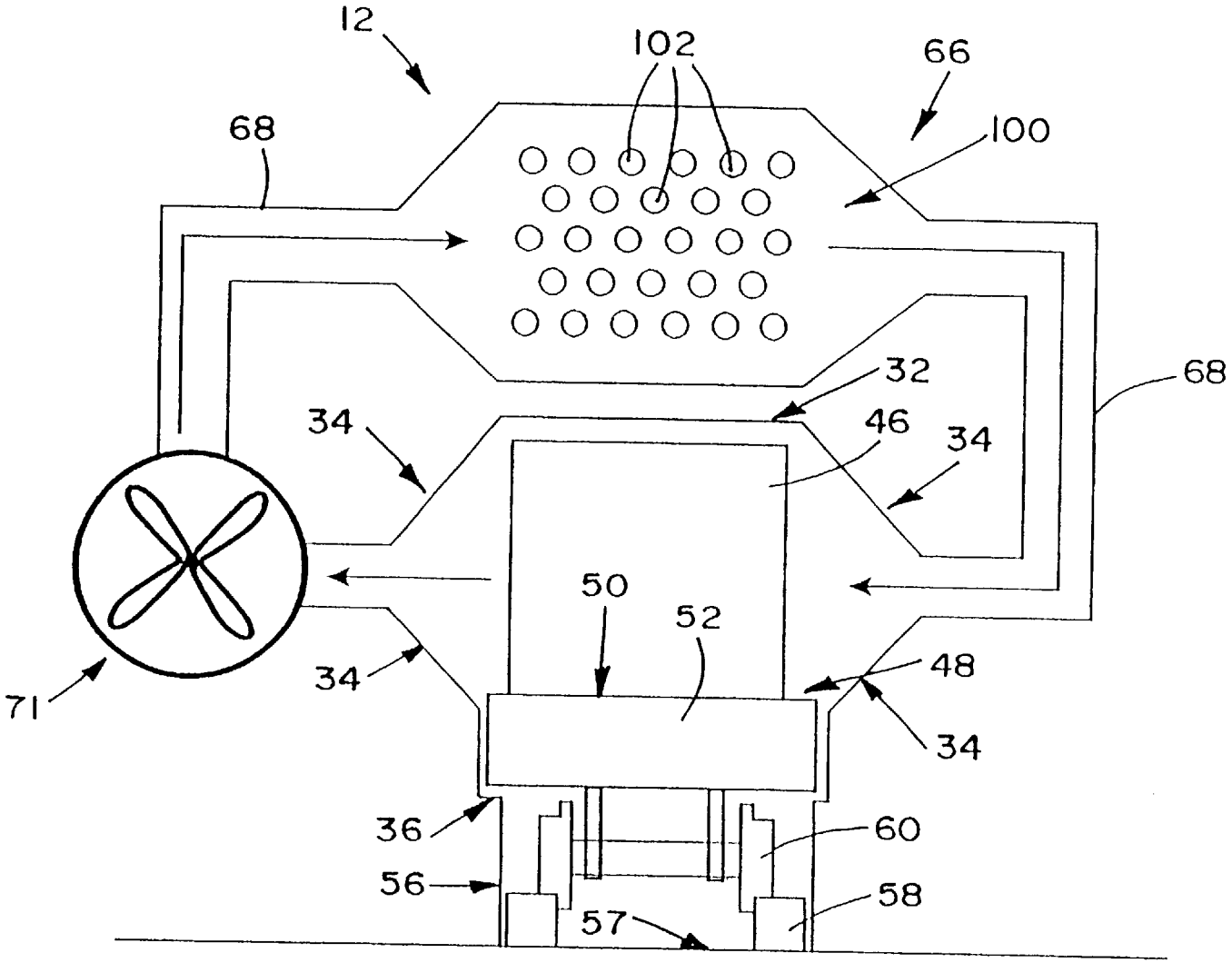
FIG. 11 shows a view similar to FIG. 8 of a further variation of the heating zone of FIG. 8.

In the case of FIG. 11, similarly, the same reference numerals are used, as in FIGS. 8 and 10, to designate the same parts, unless otherwise specified. FIG. 11 is fact corresponds with what is shown in FIG. 4, the fan 71 circulating gas from the interior of the portion 12 over the tubes 102 of the heat exchanger 100 to heat this gas, which is then circulated over the stacks 46 to pre-heat them. Combustion gas from the portion 14 passes along the interiors of the tubes 102 of the heat exchanger 100.

Figure 12:
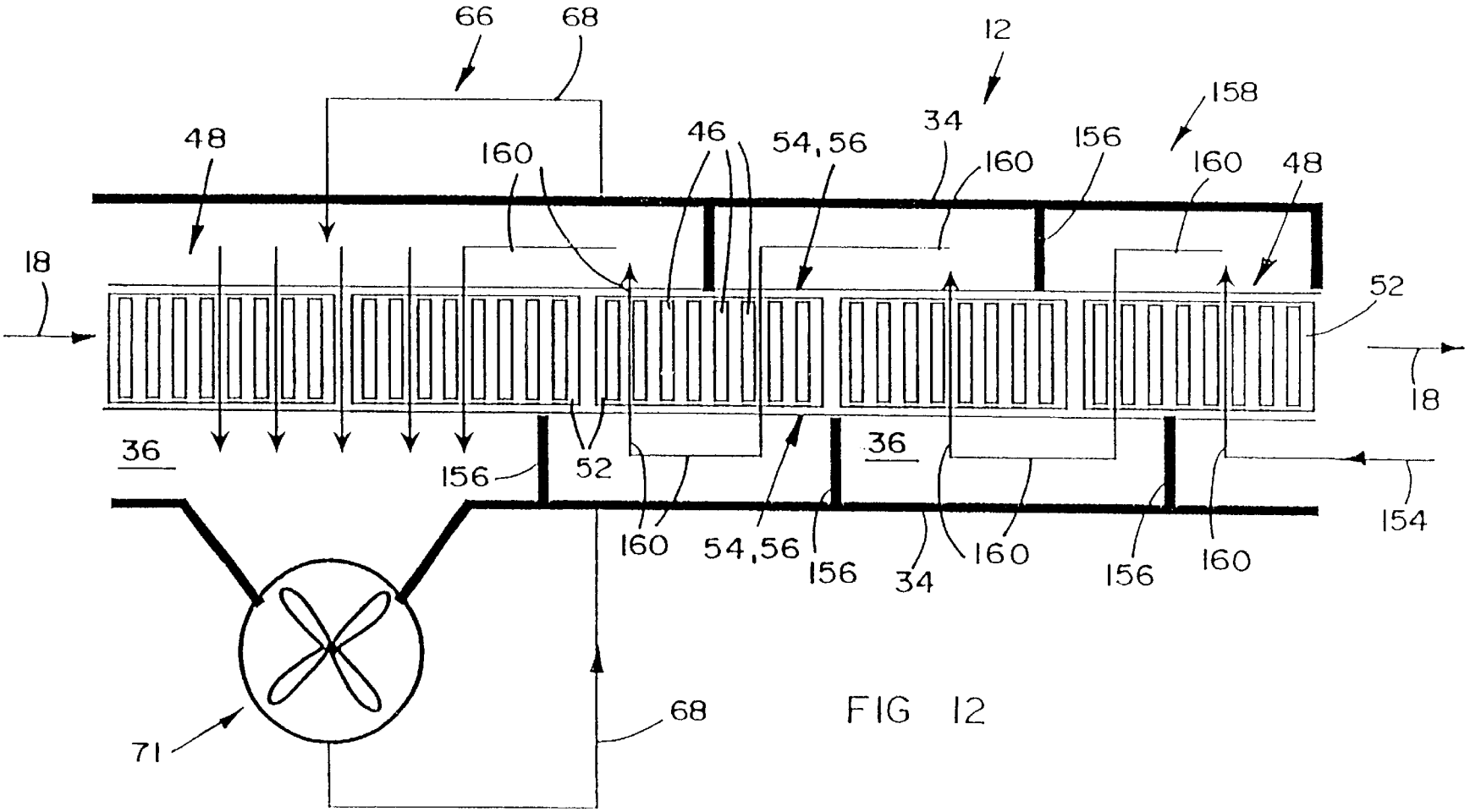
FIG. 12 shows a schematic plan view of the heating zone of a variation of the installation of the invention.

In FIG. 12 is illustrated a heating zone in the portion 12 of a kiln in accordance with the invention, which makes provision for use of combustion gases from the portion 14, without diluting them with air to cool them, before they pass over the stacks 46 of mineral. Again, the same reference numerals are used for the same parts as in FIGS. 1–11, unless otherwise stated. In FIG. 12 a plurality of baffles 156 are shown, in a transition zone 158 between the portion 14 of the kiln 10, and the part of the heating zone in the portion 12 of the kiln which contains the fans 71 and heating circuits 66, one of each of which is illustrated. The baffles 156 are arranged in two spaced series, respectively spaced along the lengths of the side walls 34 and extending upwardly from the floor 36 to the roof 32 (not shown in FIG. 12). Each baffle 156 is a panel which projects inwardly from the associated side wall 32, up to the edge of the slot 54 in the floor 36 above the channel 56 in which the rails carrying the train of trolleys 48 are located.

In use with regard to FIG. 12, extraction fan 96 in the stack 94 (see FIG. 4) withdraws gas from the portion 12 and hence from the portion 14, along line 154. Hot gases entering portion 12 from line 154 are caused by the baffles to follow a zig-zag path along the kiln 10 in the transition zone 158, as shown by arrows 160, when seen from above. By the time the gas flowing upstream (relative to arrow 18) along zig-zag path 160 reaches the most downstream fan 71 and circuit 66, in the direction of arrow 18, it has cooled sufficiently for gas temperature to drop below the 900° C. fan operating temperature.

In FIG. 13 is illustrated the concept, mentioned above in the context of FIG. 9, of having a panel or membrane 164 of refractory material such as silicon carbide laid on top of the stacks 46 of mineral on an individual trolley 48. Each trolley has its own panel 164, which is about the same length as the load bed 52 of the trolley, the panel 164 resting on a layer of powdered carbon at 166 on the top of each stack 46. In FIG. 13 the panel is shown slightly spaced above the tops of the stacks 46, but only for ease of illustration. The other reference numerals used in FIG. 13 refer to the same parts as in FIGS. 1–12, unless otherwise specified, a trolley 48 being shown with its panel 164 in the portion 14 of the kiln. In use the panels 164 divide the interior of the portion 14 above the trolleys 48 into a combustion zone in an upper combustion chamber above the panels 164 and below the roof 32, and a lower reaction zone, below the panels 164 and above the floor 36. When the reaction is a reduction using a carbonaceous reductant, the atmosphere in the reaction zone will contain substantial amounts of carbon monoxide released by the reduction. This carbon monoxide flows upwardly—see arrows 168—into the combustion chamber where it reacts with oxygen in air admitted along flow lines 110, to produce carbon dioxide which flows in the direction opposite to arrows 18 to the stack 94 and fan 96 (see FIGS. 4 and 9). As indicated above, the panels are placed on the stacks 46 at the trolley inlet end of the kiln and are removed therefrom at the trolley outlet end, a feature of the panels 164 being that breakage thereof leads to no kiln downtime.

It should be noted that use of the panels 164 of FIG. 13 has various advantages. Thus, they can be replaced or repaired when broken or damaged, without affecting kiln operation, and difficulties in designing and supporting the combustion chamber partition 104 or 156 (see FIGS. 4, 15 and 16) for use at temperatures of about 1600° C. are avoided. As the kiln roof 32 and walls 34 no longer have to support the combustion chamber partition 104 or 156, less strength of construction thereof is required, and they can be easier and cheaper to construct. Supports for the partition 104 or 156, which can lower the area available to radiate heat on to the stacks 46, are avoided. In particular, the panels 164 can be made thinner and less strong than the combustion chamber partition 104 or 156, as they will be supported by a number of closely packed mineral stacks 46. Thin panels 164 can cost less and can conduct heat more effectively.

Figure 14:
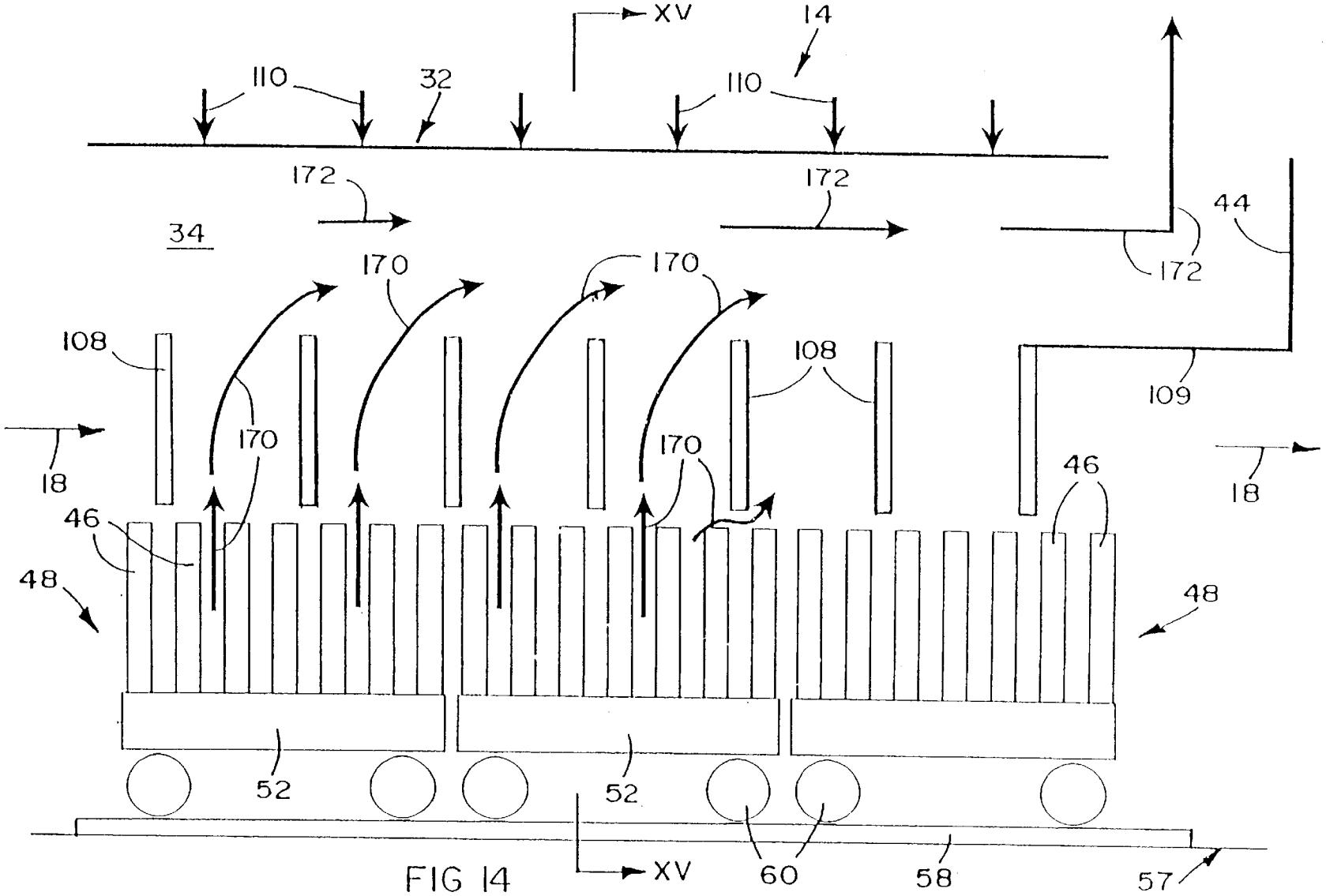
FIG. 14 shows a view similar to FIG. 13 of several trolleys forming part of a train of trolleys in the reaction zone of another installation according to the invention, in the direction of line XIV—XIV in FIG. 15.
Figure 15:
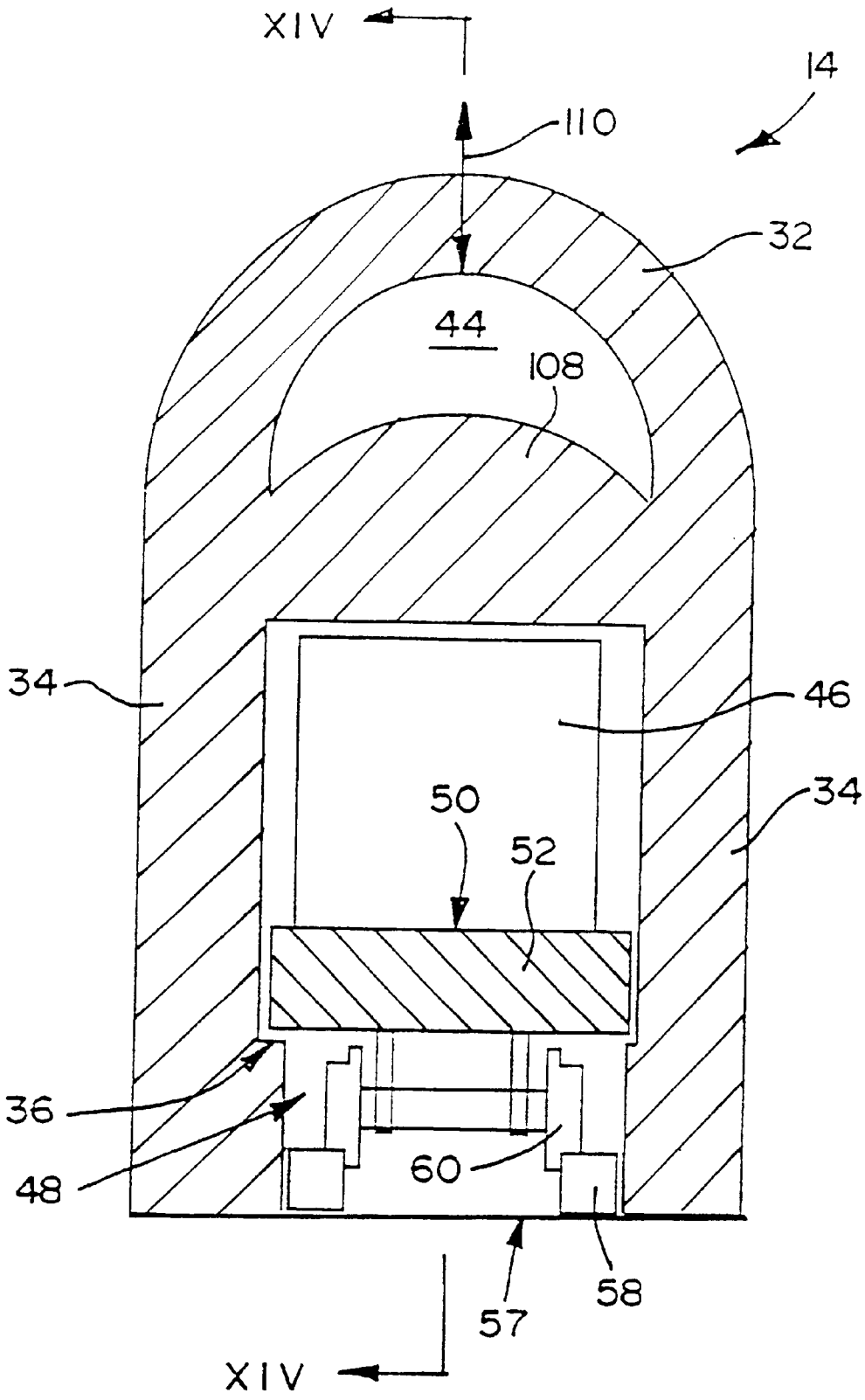
FIG. 15 shows a schematic sectional end elevation of the installation of FIG. 14, in the direction of line XV—XV in FIG. 14.

Turning to FIGS. 14 and 15, part of the portion 14 of FIG. 4 is illustrated in more detail, the same parts being designated by the same reference numerals as in FIG. 4, unless otherwise stated. (In this regard reference is also made to the baffles 108 illustrated in FIG. 4). In FIG. 14 arrows 170 illustrate the flow paths of carbon monoxide evolved in the stacks 46 in the reaction zone defined between the stacks 46 as it flows upwardly to a combustion zone above the baffles 108 and below the roof 32 (see also FIG. 4). Arrows 172 in turn show the flow of gas in the combustion zone above the baffles 108 and below the roof 32, gas flowing in this combustion zone in the downstream direction shown by arrows 18. This flow is to the downstream end of the portion 14, where combustion gases are ducted upwardly by the panel 109 and wall 44 to a duct (not shown), along which duct they flow, in an upstream direction relative to arrows 18, towards the portion 12 and heat exchanger 100 (FIG. 4). In this regard it will be appreciated that FIGS. 14 and 15 are incomplete, and do not illustrate the duct in question.

Further features of the process of the present invention include reversing fan operation of the fans 71 and/or 118, to reverse gas flow across the stacks 46 on the trolleys 48, for more even heating and/or cooling; and, as mentioned above, having alternate fans feeding air in opposite directions across the stacks 46 can reduce mixing of the flow caused by any fan with the flows caused by adjacent fans unless, naturally, the fan 96 is sucking gas along the portions 12 and/or 16 and discharging it up the stack 94. If soot on the heat exchange surfaces such as heat exchanger tubes is a problem, air or oxygen may be used to burn volatiles in the kiln arising from carbonaceous reductants. Generally consolidated shapes making up the stacks 46 should be thin enough to promote gas diffusion, while being thick enough to be self supporting, being in this sense a compromise.

A last aspect of the invention is the kiln without the partition 104 or 156 or baffles 108. Gas is burnt in the combustion space above the stacks, producing oxidizing gaseous compounds. Although oxidizing, these compounds do not react with the mineral material because they are prevented from coming into contact with the material in the stacks by tending to flow towards the top of the kiln, because they are hotter than the reducing gas between the stacks; by being restricted from flowing downwardly between the stacks by the stack shapes acting as baffles; and by being restricted from diffusing into the stacks by flow of product gas from the reaction of the material, out of the stacks and by the dense packing of the solid material particles in the stacks. The last mechanism can further be enhanced by the addition of fluxes to the material that tend to block the pores in the material, restricting such diffusion almost totally.

What is claimed is:

1. A process for the treatment of a solid material, the process including the process steps of:

passing the solid material along the inside of a kiln comprising a horizontally extending tunnel having a hollow interior;

supporting the solid material on a succession of supports as it passes along the kiln, the supports being moved successively along the interior of the kiln; and heating the solid material, by means of radiant heat radiated on to the solid material, as it passes along the kiln, to a temperature at which the solid material undergoes an endothermic chemical reduction reaction, the heat which is radiated on to the solid material being produced by combustion in a combustion zone separated by at least one partition in the form of a panel from a reaction zone through which the solid material supported on the supports passes during the heating, the process further comprising, in combination, the process steps of:

prior to the passing of the solid material along the inside of the kiln, admixing particles of the solid material with a carbon-containing reductant so that the heating of the solid material gives rise to combustible gases produced by the reductant admixed with the solid material;

loading the admixed particles of the solid material and the reductant on each support at a plurality of positions at least partly spaced apart by spaces therebetween; and burning the combustible gases produced by the heating to provide the combustion in the combustion zone which produces the heat which heats the solid material, the heating of the solid material being by radiant heat emitted by at least one heating surface, in the interior of the kiln, provided by a said partition in the form of a panel which separates the kiln interior into a said combustion zone and a said reaction zone which extend alongside each other lengthwise along the interior of the kiln.

2. A process as claimed in claim 1, in which each support is in the form of a wheeled trolley, the process including loading a succession of the trolleys with the solid material to be treated, each trolley being loaded on an upwardly facing support surface of a load bed of the trolley, the moving of the supports along the interior of the kiln being by rolling the loaded trolleys in succession along a path extending, below the interior of the kiln, along the length of the kiln.

3. A process as claimed in claim 2, in which the kiln has an inlet end and an outlet end, each of which ends is provided with an airlock, the process including the steps of inserting the loaded trolleys in succession into the inlet end of the kiln, and withdrawing the loaded trolleys in succession from the outlet end of the kiln, the airlocks acting to promote the maintenance of an atmosphere inside the kiln which is different from the ambient atmosphere outside the kiln, which atmosphere inside the kiln promotes the endothermic reaction.

4. A process as claimed in claim 1, in which each heating surface faces towards the solid material passing along the kiln, each heating surface being provided by a stationary partition in the interior of the kiln and forming part of the kiln structure defining the outer periphery of the reaction zone, each partition being flattened to have a pair of major faces respectively forming opposite sides thereof and facing respectively towards and away from the solid material, each partition being heated by a combustion gas located on the side of the partition facing away from the solid material.

5. A process as claimed in claim 1, which includes the step, after the admixing of the particles of the solid material with the carbon-containing reductant, of consolidating particles of the solid material into shapes to promote heating thereof in the kiln, the shapes being stacked on the supports, and the process including the step, after the admixing of the particles of the solid material with the carbon-containing reductant, of removing, from the vicinity of the shapes, any gaseous products formed by the heating of the shapes.

6. A process as claimed in claim 5, in which the consolidation is into shapes of a size such that the process produces a product in the form of shapes of reduced solid material which can subsequently be smelted without any size reduction prior to the smelting thereof.

7. A process as claimed in claim 5, which includes the step, after the endothermic chemical reaction of the solid material, of smelting the solid material.

8. A process as claimed in claim 1, which includes the step, prior to the radiant heating thereof to cause the endothermic reaction, of pre-heating the solid material, and includes, after said radiant heating, the step of cooling the solid material.

9. A process as claimed in claim 1, which includes the step of heating the solid material on the supports by means of a plurality of heating membranes, one for each support, each heating membrane being a mobile panel supported on one of the supports and passing along the inside of the kiln on said support, the heating membranes radiating the radiant heat on to the solid material on said support and the process including using each membrane to heat solid material in turn on each of a plurality of the supports passing along the kiln.

10. A process as claimed in claim 1, in which the loading of the admixed particles of the solid material and the reductant at a plurality of spaced positions on each support is selected from the group consisting of loading a plurality of trays, each having the admixed particles of the solid material and the reductant loaded thereon, at spaced positions on each support, and loading a plurality of consolidated shapes, each comprising the admixed particles of the solid material and the reductant, at spaced positions on each support.

11. A process for the treatment of a solid material, the process including the process steps of:

passing the solid material along the inside of a kiln comprising a horizontally extending tunnel having a hollow interior;

supporting the solid material on a succession of supports as it passes along the kiln, the supports being moved successively along the interior of the kiln; and heating the solid material, by means of radiant heat radiated on to the solid material, as it passes along the kiln, to a temperature at which the solid material undergoes an endothermic chemical reduction reaction, the process including the step of consolidating particles of the solid material into shapes which are arranged in stacks on the supports, the process including the step, after the heating, of subjecting the solid material to further processing which destroys the shapes.

12. An installation for the treatment of solid material undergoing an endothermic chemical reaction, the installation including:

a kiln in the form of a horizontally extending tunnel having a hollow interior with an inlet end and an outlet end, the tunnel having a roof, a floor and a pair of opposed side walls;

a path for supports loaded with the solid material to pass along in the interior of the tunnel in succession, from the inlet end of the kiln to the outlet end thereof, the path extending along the floor at the bottom of the interior of the tunnel from the inlet end of the kiln to the outlet end thereof;

at least one heating surface for radiating radiant heat towards solid material loaded on supports passing along the path from said inlet end to said outlet end; and a plurality of supports, movable in succession along the path from the inlet end of the kiln to the outlet end thereof, the kiln having a reaction chamber in the interior of the tunnel which is separated from a combustion chamber in the interior of the tunnel by at least one partition in the form of a panel, the floor of the tunnel providing a floor for the reaction chamber along which reaction chamber floor the path for the supports extends, each said heating surface being provided by a said partition in the form of a panel separating the kiln interior into a said combustion chamber and a said reaction chamber which extend together lengthwise along the interior of the kiln, the installation including a gas feed feeding into each combustion chamber, for feeding combustible gas produced in the reaction chamber from a position adjacent the outlet end of the reaction chamber into each combustion chamber.

13. An installation as claimed in claim 12, in which the supports are in the form of wheeled trolleys, the path being in the form of a track comprising a pair of spaced rails for supporting the wheels of the trolleys.

14. An installation as claimed in claim 12, which includes an inlet airlock into the kiln at the inlet end of the kiln, and an outlet airlock out of the kiln at the outlet end of the kiln, for promoting isolation of an atmosphere in the interior of the kiln from the ambient atmosphere outside the kiln.

15. An installation as claimed in claim 12, in which the path is in the form of a channel extending along the length of the floor of the tunnel, for receiving the supports, each support having an upwardly facing load bed at the same height as the floor of the tunnel.

16. An installation as claimed in claim 12, in which the kiln has a reaction zone in which each heating surface is provided.

17. An installation as claimed in claim 16, in which each heating surface is provided by a longitudinal partition in the form of an elongated panel extending longitudinally along the interior of the tunnel and separating the reaction chamber from the combustion chamber.

18. An installation as claimed in claim 16, in which the tunnel is provided, in the reaction zone, with a plurality of longitudinally spaced baffles in the form of transverse partitions extending between the side walls, the baffles being spaced below the roof of the tunnel and spaced above the floor of the tunnel.

19. An installation as claimed in claim 18, in which there are a plurality of the transverse partitions in the heating zone on opposite sides of the path, the partitions in the heating zone on each side of the path being staggered with regard to the partitions in the heating zone on the opposite side of the path, thereby being arranged to encourage gas flowing along the length of the tunnel in the heating zone to follow a zig-zag path along the heating zone, from side to side across the path and across any solid material on supports on the path.

20. An installation as claimed in claim 16, in which the kiln has a heating zone between the reaction zone and the inlet end of the kiln and a cooling zone between the reaction zone and the outlet end of the kiln, the heating zone and the cooling zone respectively being in communication with opposite ends of the reaction zone, and the path extending along the floor of the tunnel in the heating zone and in the cooling zone.

21. An installation as claimed in claim 20, in which the tunnel has, in its interior, a plurality of transverse partitions on each side of the path, the partitions resisting gas flow along the tunnel on opposite sides of the path in the heating zone and the cooling zone, and the partitions resisting gas flow along the kiln on opposite sides of the path, into and out of the reaction zone.

22. An installation as claimed in claim 12, in which each partition which provides a heating surface is selected from the group consisting of roof panels, each spaced vertically by a said combustion chamber from the roof for radiating radiant heat downwardly towards the solid material, and wall panels, each spaced horizontally by a said combustion chamber from one of the side walls, for radiating radiant heat horizontally towards the solid material.

23. A kiln for the treatment of solid material undergoing an endothermic chemical reaction, the kiln including:

a horizontally extending tunnel having a hollow interior with an inlet end and an outlet end, the tunnel having a roof, a floor and a pair of opposed side walls;

a path for supports loaded with solid material to pass along in the interior or the tunnel in succession, from the inlet end of the kiln to the outlet end thereof, the path extending along the floor at the bottom of the interior of the tunnel from the inlet end of the kiln to the outlet end thereof; and at least one heating surface for radiating radiant heat towards solid material loaded on supports passing along the path from said inlet end to said outlet end, the kiln having a reaction chamber in the interior of the tunnel which is separated from a combustion chamber in the interior of the tunnel by at least one partition in the form of a panel, the floor of the tunnel providing a floor for the reaction chamber along which reaction chamber floor the path for the supports extends, each said heating surface being provided by a said partition in the form of a panel separating the kiln interior into a said combustion chamber and a said reaction chamber which extend together lengthwise along the interior of the kiln, the kiln including a gas feed feeding into each combustion chamber, for feeding combustible gas produced in the reaction chamber from a position adjacent the outlet end of the reaction chamber into each combustion chamber.

* * * * *